US009241870B2

(12) United States Patent
Horn

(10) Patent No.: US 9,241,870 B2
(45) Date of Patent: Jan. 26, 2016

(54) MEDICINE DISPENSING RECORD SYSTEM

(71) Applicant: Kimberlee Ann Horn, Romney, IN (US)

(72) Inventor: Kimberlee Ann Horn, Romney, IN (US)

( * ) Notice: Subject to any disclaimer, the term of this patent is extended or adjusted under 35 U.S.C. 154(b) by 0 days.

(21) Appl. No.: 14/120,427

(22) Filed: Oct. 23, 2013

(65) Prior Publication Data

US 2015/0108016 A1 Apr. 23, 2015

(51) Int. Cl.

| | |
|---|---|
| ***A61J 1/00*** | (2006.01) |
| ***B43K 23/00*** | (2006.01) |
| ***B65D 25/20*** | (2006.01) |
| ***A61J 1/14*** | (2006.01) |

(52) U.S. Cl.

CPC *A61J 1/00* (2013.01); *A61J 1/1412* (2013.01); *B43K 23/001* (2013.01); *B65D 25/20* (2013.01); *A61J 2205/30* (2013.01)

(58) Field of Classification Search

CPC ..... A47G 29/08; A61J 1/03; A61J 7/04; B65D 51/245; B65D 83/04; B65D 83/0481; B43K 23/001; B43K 23/002

USPC ..... 206/232, 528, 534, 540, 459.5; 248/72.1–74.3, 229.1–229.26, 316.7, 248/205.3; 211/69.1, 69.8, 69.9

See application file for complete search history.

(56) References Cited

U.S. PATENT DOCUMENTS

| | | | | |
|---|---|---|---|---|
| 1,330,470 | A * | 2/1920 | Jutila | 211/69.2 |
| 1,466,057 | A * | 8/1923 | Mathews | 211/69.8 |
| 2,892,595 | A | 6/1959 | Tupper | |
| 4,405,045 | A | 9/1983 | Villa-Real | |
| 5,011,032 | A | 4/1991 | Rollman | |
| 5,105,949 | A | 4/1992 | Blair | |
| 5,261,702 | A | 11/1993 | Mayfield | |
| 5,820,095 | A * | 10/1998 | Stone | 248/316.7 |
| 5,947,329 | A | 9/1999 | Bailey | |
| 6,036,017 | A * | 3/2000 | Bayliss, IV | 206/534 |
| 6,386,367 | B1 * | 5/2002 | Bayliss, IV | 206/534 |
| 6,565,054 | B2 * | 5/2003 | Weesner et al. | 248/316.1 |
| 6,620,500 | B2 | 9/2003 | Sweet et al. | |
| 7,554,434 | B1 * | 6/2009 | Gifford et al. | 215/230 |
| 8,033,409 | B2 | 10/2011 | Lindemann | |
| D675,097 | S | 1/2013 | Burke, Jr. | |
| 8,456,287 | B2 * | 6/2013 | Gifford et al. | 206/534 |
| D689,688 | S | 9/2013 | Horn | |
| 2005/0029155 | A1 | 2/2005 | Edwards | |
| 2006/0124501 | A1 | 6/2006 | McNeely | |
| 2006/0124578 | A1 | 6/2006 | Yousif et al. | |
| 2009/0314680 | A1 | 12/2009 | Gifford | |
| 2010/0072163 | A1 | 3/2010 | Krause | |
| 2012/0138563 | A1 | 6/2012 | Brumfield | |
| 2012/0170966 | A1 | 7/2012 | Novak | |
| 2012/0223045 | A1 | 9/2012 | Burke, Jr. | |
| 2012/0305177 | A1 | 12/2012 | Simmons et al. | |
| 2014/0209489 | A1 | 7/2014 | Horn | |
| 2014/0224236 | A1 | 8/2014 | McPherson | |

* cited by examiner

*Primary Examiner* — Bryon Gehman

(74) *Attorney, Agent, or Firm* — James Ray & Assoc. LLC

(57) ABSTRACT

An article of manufacture includes a marking member configured for writing and erasing thereon, a peripheral rim extending from the marking member and having an interior surface thereof configured for attachment onto an open end of a container, and a holder disposed on at least an exterior surface of the peripheral rim, the holder configured to releaseably secure a writing implement.

18 Claims, 37 Drawing Sheets completely encased marker
opposite of Fig. 58-61 & 57 grippy band that could be removed from container.

ADVANTAGE – COULD be reused

MEDICINE DISPENSING RECORD SYSTEM

FIELD OF THE INVENTION

The present invention relates generally to medicine containers. More specifically, the instant invention provides a cap with a writing and erasable surface for a medicine container so as to enable a person to record content and/or administration information of the medicine. The instant invention also provides a novel medicine container configured to releaseably retain a writing implement.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, one of the recommendations to reduce medication errors and harm is to use the "Five Rights of Medicine Administration": the right patient, the right drug, the right amount, the right route, and the right time. However, the five rights should be accepted as a goal of the medication process not the "be all and end all" of medication safety. It is important to follow the rules of the five rights of patient medication administration to keep the patient safe and prevent harm. Medical professional errors often occur in the medical field, and utilizing the five rights points can help to avoid these errors.

It is important for every medical professional and/or caregiver to be knowledgeable about the medication being given to the patient. It is not possible for every medical professional to know the drug facts on every drug. To be safe and competent, the medical professional should look up unfamiliar drug information before giving the medication to the patient. The patient has the right to information on the medication, the right to receive the correct medication, and the right to have a medical professional knowledgeable in the medication they are providing. Examples of the Five Rights of Medicine Administration may include:

Right Patient—Be sure you have the right patient before administering medication; Ask the patient to state their full name.

Right Drug—Check the bottle's label against the physician's authorization; Be sure they match.

Right Amount—Double check the amount of medication before administering; Be sure the amount to be given is clearly understood.

Right Time—Medication is to be given in substantial compliance with the physician's request; Within one half hour before or after the scheduled time.

Right Route—Designated medical professionals are authorized to administer oral medication only; Do not administer ear, eye, nose drops, topical medication, or injected medication.

Generally, the right amount, right day and right time are the most important parameters associated with consumption of medicine, particularly of the prescription type.

Typically, medicine may include a special food or a chemical that makes someone better when they are ill. A lot of medicines are liquids and can be bought in a small bottle. Other medicines may come in pills or capsules. The doctor may tell the patient or caregiver how much medicine to take each day. Most medicines cannot be bought unless a doctor (or other authorized professional) has prescribed the medicine for the patient. Often, the doctor or pharmacist provide specific instructions for administering the medicine, including dosages, quantities, and warnings.

Typically, medicine containers are containers that contain medicine prescribed by doctors. Medicine containers come in different shapes, sizes, and colors. The most common is an orange pill bottle, opaque liquid bottle or a pill box.

Typically, dosage forms are a mixture of active drug components and nondrug components. Depending on the method of administration they come in several types. These are liquid dosage form, solid dosage form and semisolid dosage forms. Various dosage forms may exist for a single particular drug, since different medical conditions can warrant different routes of administration. Additionally, a specific dosage form may be a requirement for certain kinds of drugs, as there may be issues with various factors like chemical stability or pharmacokinetics. The oral and intravenous doses of a medicine may also vary depending on the patient, the strength of the medication, and the severity of the illness.

Although Applicant's previous efforts improved medicine dispensing record system by providing a medicine container or a cap with a built-in or integrated marking or mark-on surface, further improvements have been found necessary, particularly in enabling attachment of a writing implement and protecting marked information from being unintentionally or accidentally removed or distorted.

SUMMARY OF THE INVENTION

An article of manufacture includes a marking surface configured for writing and erasing thereon, a peripheral rim extending from the marking surface and having an interior surface thereof configured for attachment onto an open end of a container, and a holder disposed on at least an exterior surface of the peripheral rim, the holder configured to releaseably secure a writing implement.

OBJECTS OF THE INVENTION

Accordingly, an object of the instant invention is to provide a cap that is configured for a releaseable attachment onto an open end of a conventional medicine container, includes an end surface for writing and erasing thereon and further includes a clip attached to the peripheral side surface for holding a writing implement.

A further object of the instant invention is to provide a cap that is configured for a releaseable attachment onto an open end of a conventional medicine container, includes an end surface for writing and erasing thereon, and further includes a rim upstanding above the surface and a clip attached to a peripheral side surface of a rim for holding a writing implement.

Another object of the instant invention is to provide a cap that is configured for a releaseable attachment onto an open end of a conventional medicine container, includes a surface for writing and erasing thereon with a rim upstanding above the surface and further includes a transparent cover that is hingeably attached to the rim so as to allow and prevent access to the surface.

Another object of the instant invention is to provide a cap that is configured for a releaseable attachment onto an open end of a conventional medicine container, includes a surface for writing and erasing thereon and further includes a transparent cover that is hingeably attached to the cap and has a rim configured to upstand on the surface when the cover is in the closed position so as to allow and prevent access to the surface.

An additional object of the instant invention is to provide a medicine container having a pocket configured to releaseably receive a writing implement therein.

A further object of the instant invention is to provide a cap that is configured for a releaseable attachment onto an open end of a conventional medicine container, includes an end surface for writing and erasing thereon and a rim upstanding above the surface and further provide a medicine container having a pocket configured to releaseably receive a writing implement therein.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

DETAILED DESCRIPTION OF THE INVENTION

Figure 1:
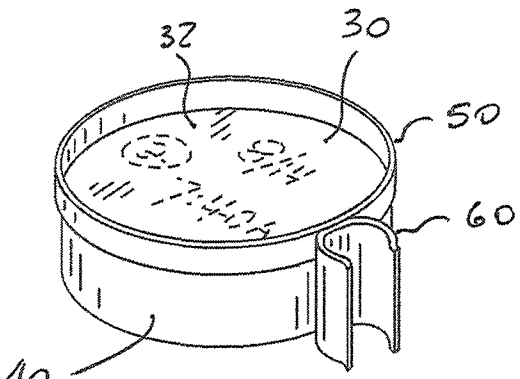
FIG. 1 is a perspective view of a cap with a writing and erasable surface for a medicine container.
Figure 2:
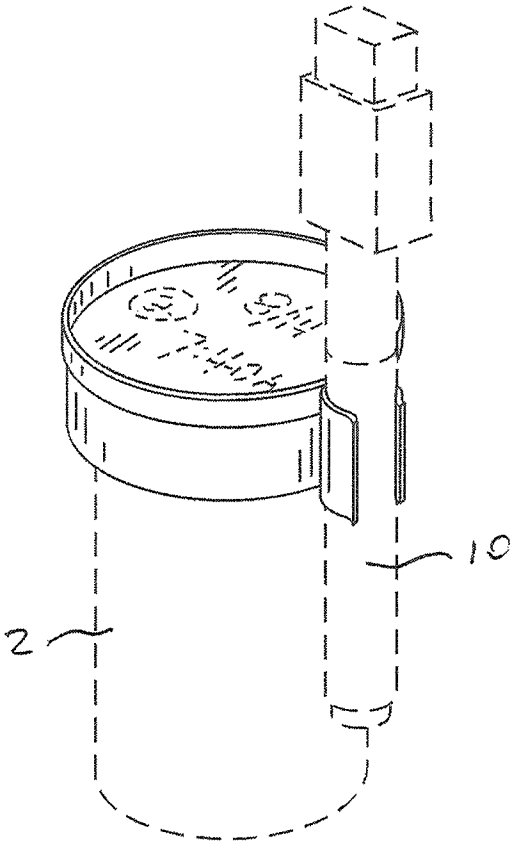
FIG. 2 is a perspective environmental view of a cap of FIG. 1 in combination with a medicine container and writing implement, shown in broken lines.
Figure 3:
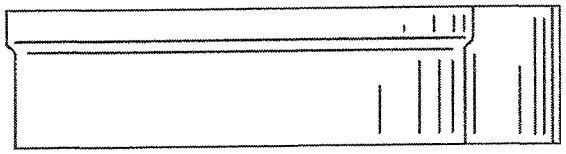
FIG. 3 is a front elevation view of the cap in FIG. 1.
Figure 5:
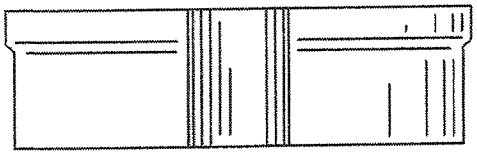
FIG. 5 is a right side elevation view of the cap in FIG. 1.
Figure 4:
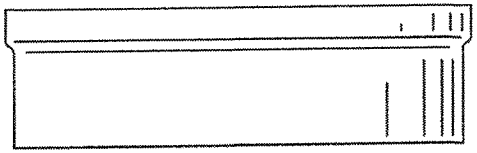
FIG. 4 is a left side elevation view of the cap in FIG. 1.
Figure 7:
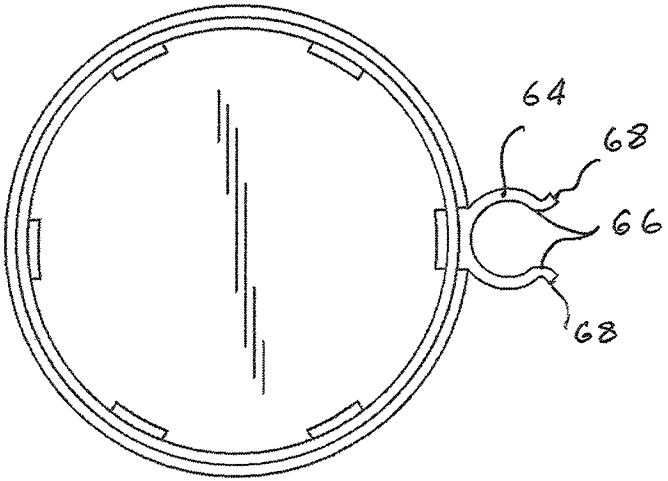
FIG. 7 is a bottom plan view of the cap in FIG. 1.
Figure 6:
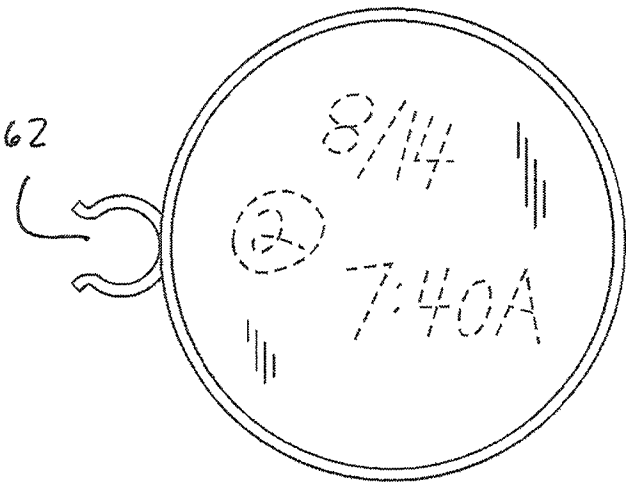
FIG. 6 is a top plan view of the cap in FIG. 1.
Figure 9:
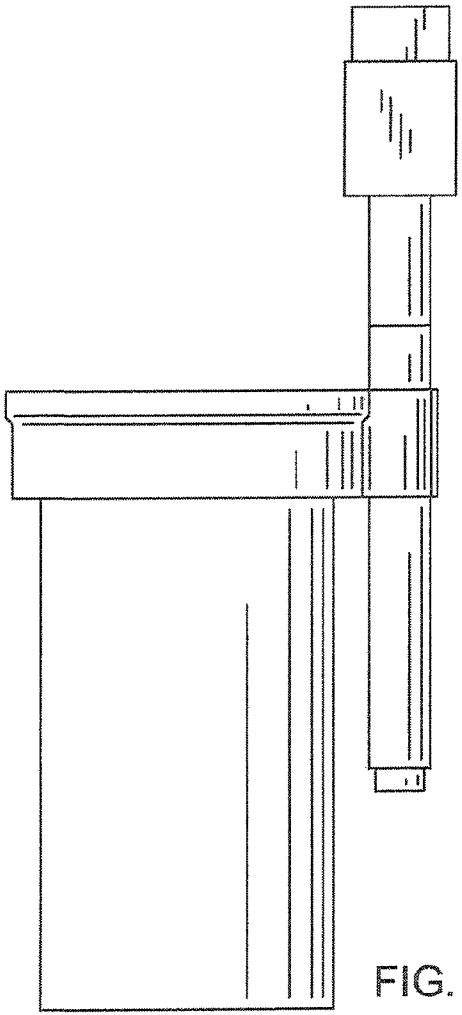
FIG. 9 is a front elevation view of the cap in FIG. 8.
Figure 8:
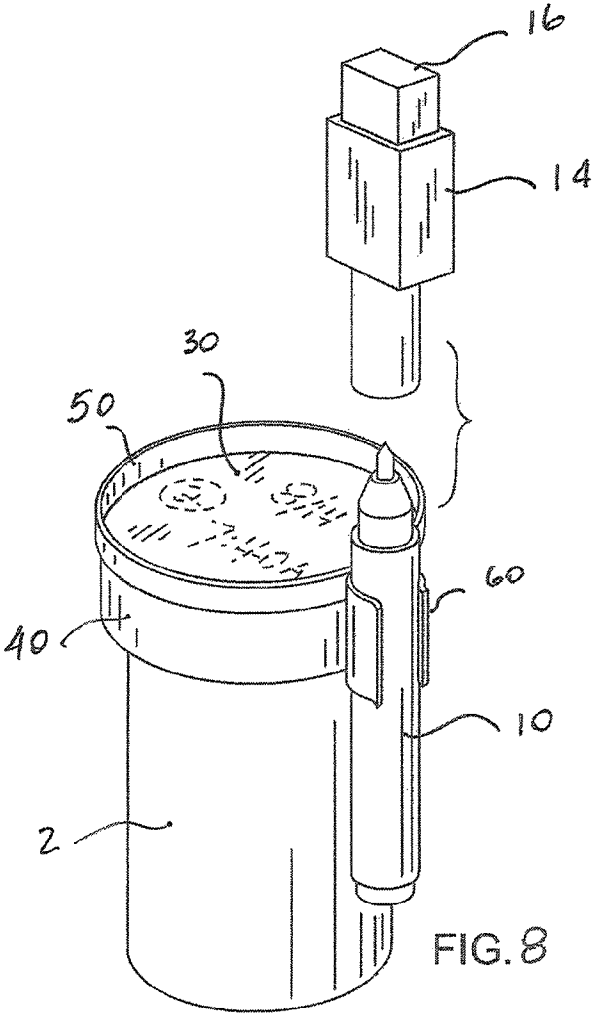
FIG. 8 is a perspective view of a system including a medicine container, a cap with a writing and erasable surface for the medicine container and a writing implement, partially exploded.
Figure 11:
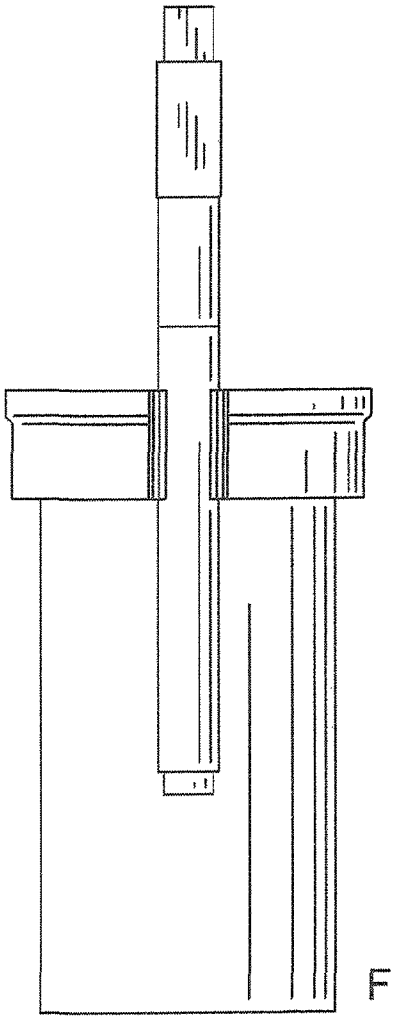
FIG. 11 is a right side elevation view of the cap in FIG. 8.
Figure 10:
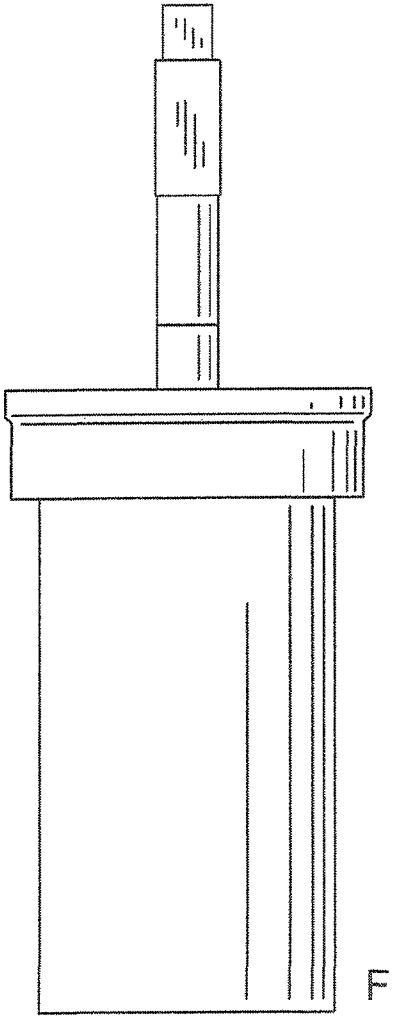
FIG. 10 is a left side elevation view of the cap in FIG. 8.
Figure 13:
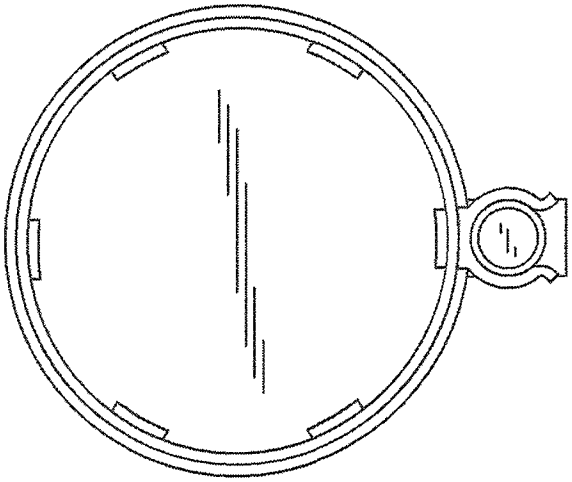
FIG. 13 is a bottom plan view of the cap in FIG. 8.
Figure 12:
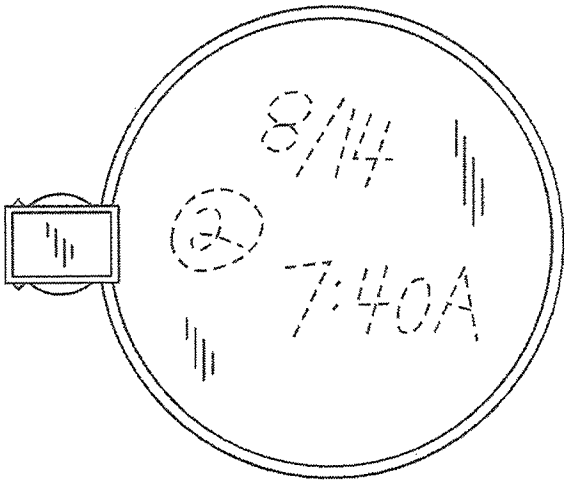
FIG. 12 is a top plan view of the cap in FIG. 8.
Figure 15:
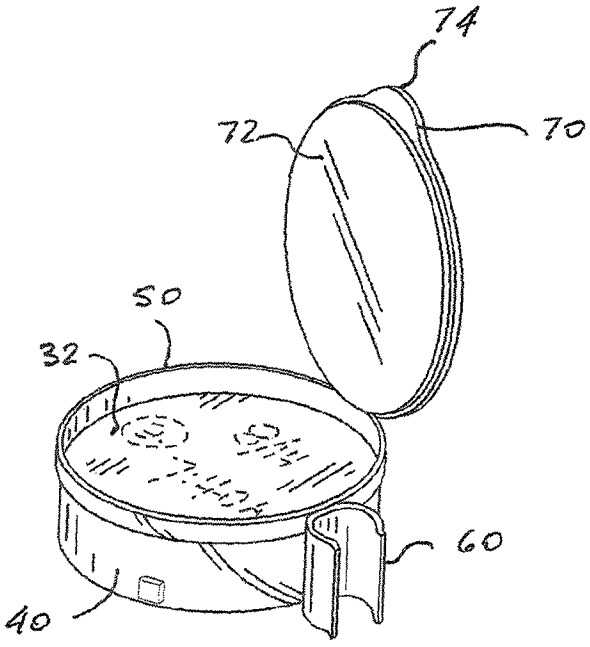
FIG. 15 is another perspective environmental view of the cap of FIG. 14.
Figure 14:
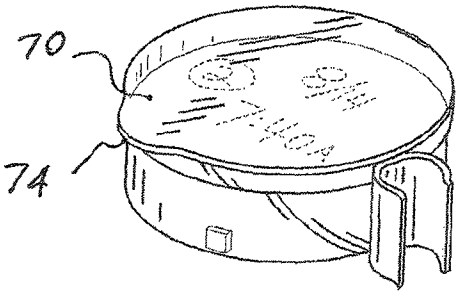
FIG. 14 is one perspective environmental view of a cap of another embodiment with a writing and erasable surface for a medicine container.
Figure 17:
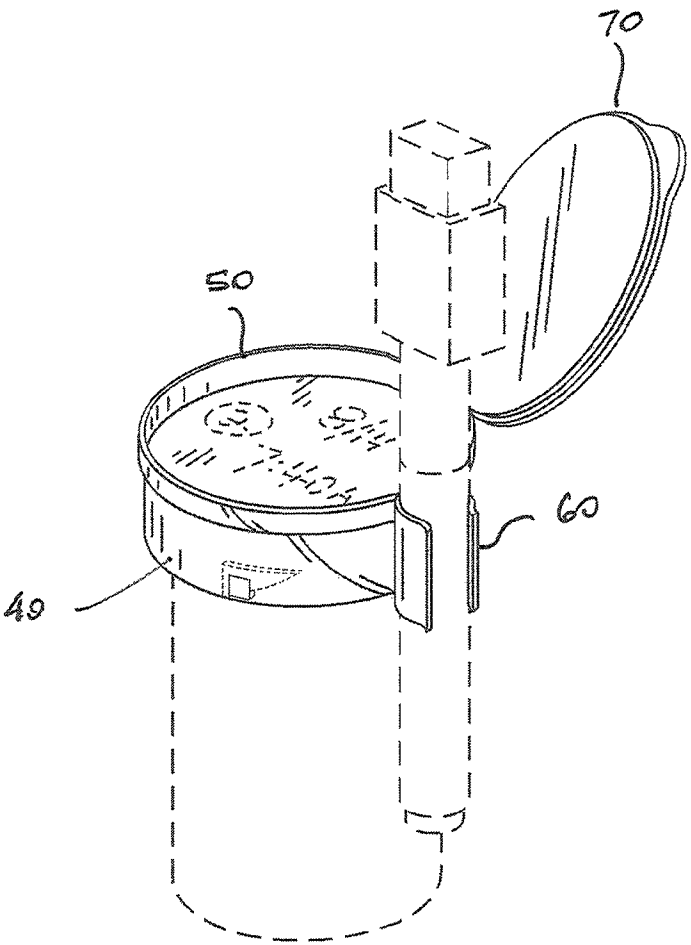
FIG. 17 is a perspective environmental view of the cap of FIG. 15 in combination with a medicine container and writing implement, shown in broken lines.
Figure 16:
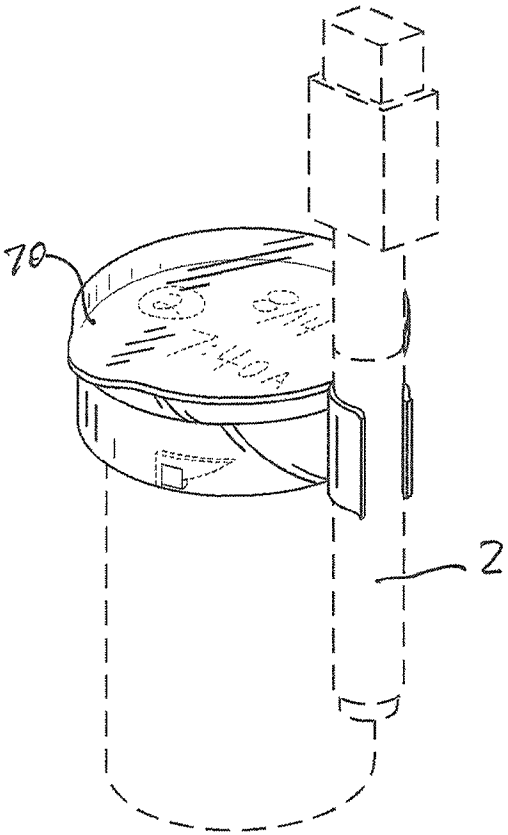
FIG. 16 is a perspective environmental view of the cap of FIG. 14 in combination with a medicine container and writing implement, shown in broken lines.
Figure 19:
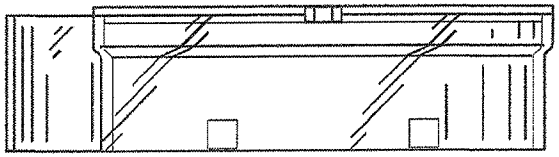
FIG. 19 is a rear elevation view of the cap in FIG. 14.
Figure 18:
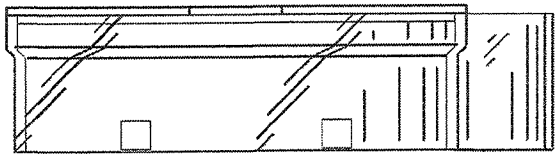
FIG. 18 is a front elevation view of the cap in FIG. 14.
Figure 20:
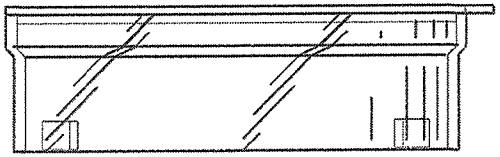
FIG. 20 is a left side elevation view of the cap in FIG. 14.
Figure 22:
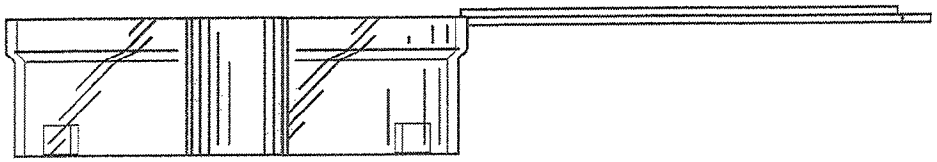
FIG. 22 is a right side elevation view of the cap in FIG. 15.
Figure 21:
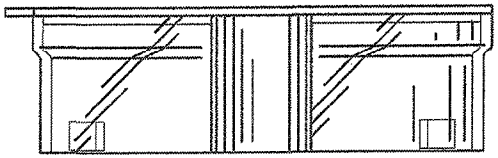
FIG. 21 is a right side elevation view of the cap in FIG. 14.
Figure 24:
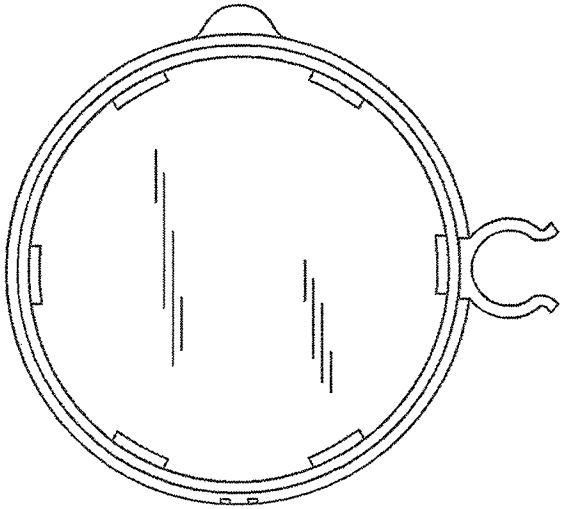
FIG. 24 is a bottom plan view of the cap in FIG. 14.
Figure 23:
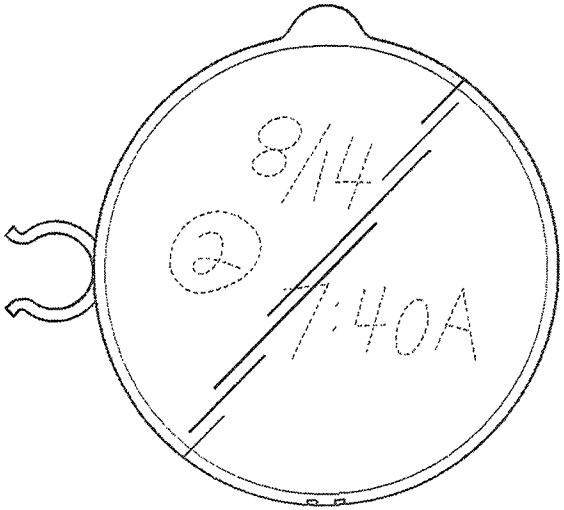
FIG. 23 is a top plan view of the cap in FIG. 14.
Figure 26:
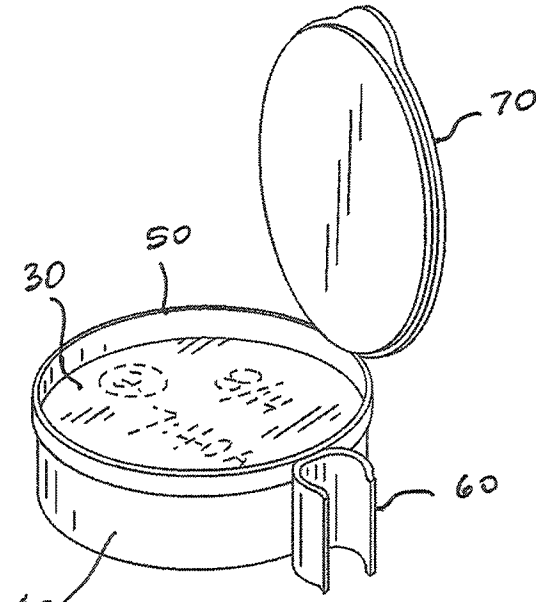
FIG. 26 is another perspective environmental view of the cap of FIG. 25.
Figure 25:
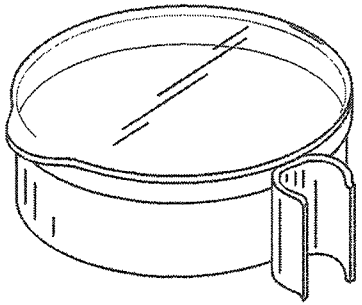
FIG. 25 is one perspective environmental view of a cap of another embodiment with a writing and erasable surface for a medicine container.
Figure 28:
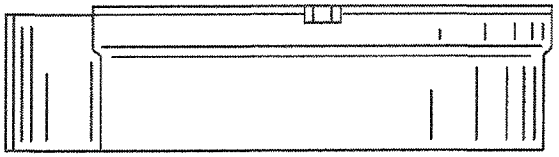
FIG. 28 is a rear elevation view of the cap in FIG. 25.
Figure 29:
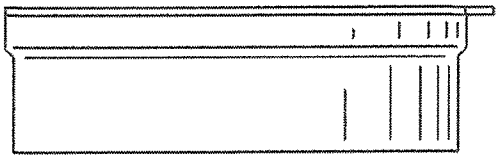
FIG. 29 is a left side elevation view of the cap in FIG. 25.
Figure 31:
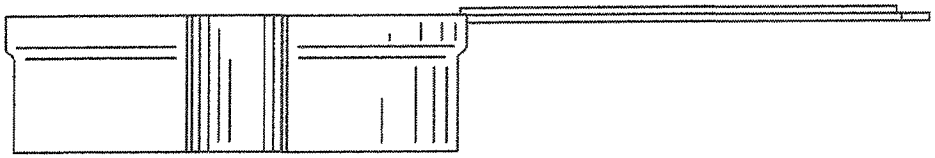
FIG. 31 is a right side elevation view of the cap in FIG. 26.
Figure 27:
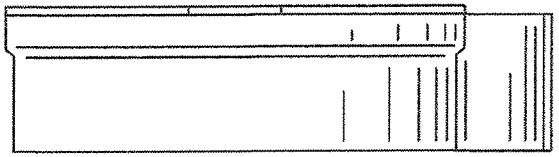
FIG. 27 is a front elevation view of the cap in FIG. 25.
Figure 30:
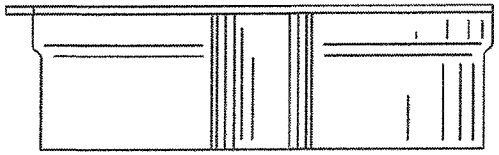
FIG. 30 is a right side elevation view of the cap in FIG. 25.
Figure 33:
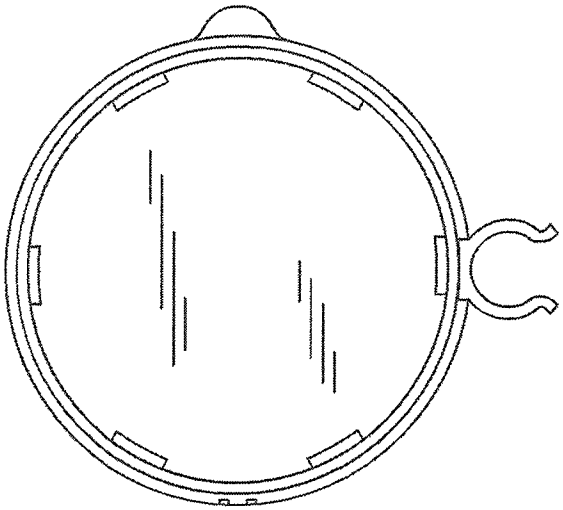
FIG. 33 is a bottom plan view of the cap in FIG. 25.
Figure 32:
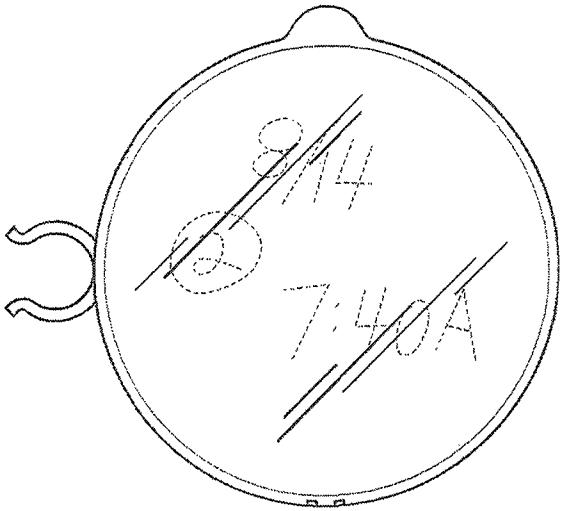
FIG. 32 is a top plan view of the cap in FIG. 25.
Figure 35:
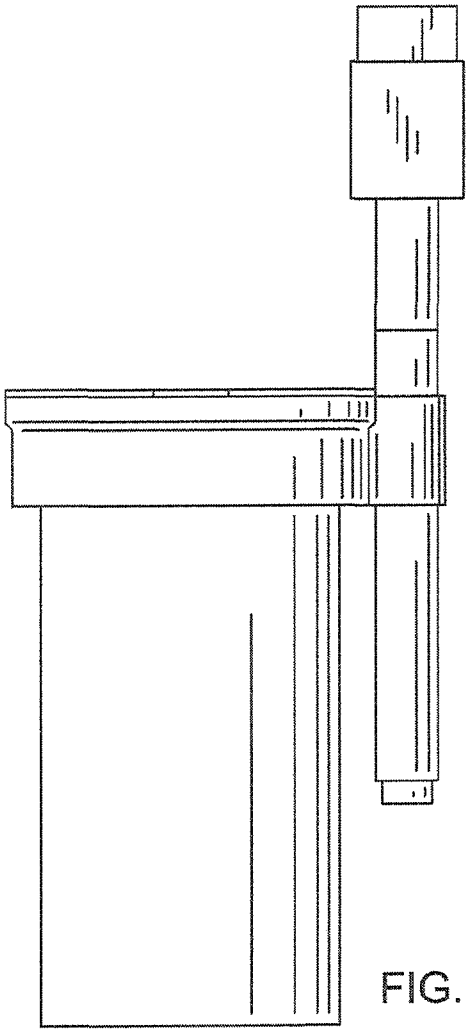
FIG. 35 is a front elevation view of the cap in FIG. 34.
Figure 34:
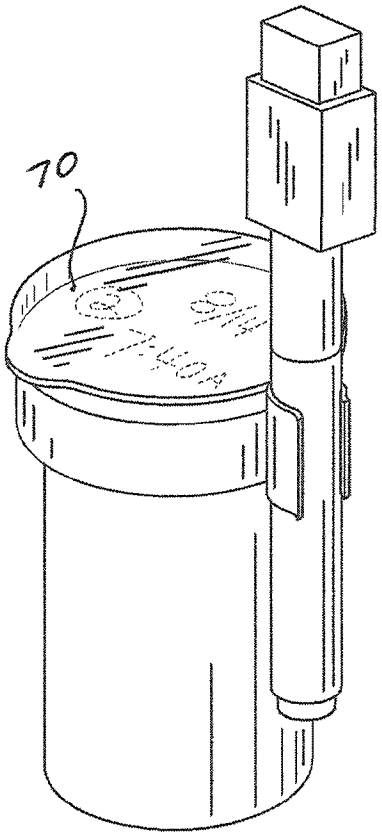
FIG. 34 is a perspective view of a system including a medicine container, a cap with a writing and erasable surface for the medicine container and a writing implement.
Figure 37:
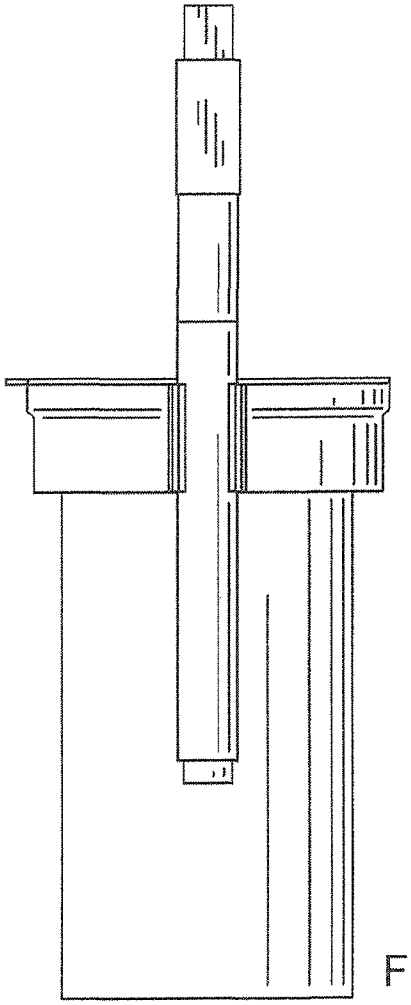
FIG. 37 is a right side elevation view of the cap in FIG. 34.
Figure 36:
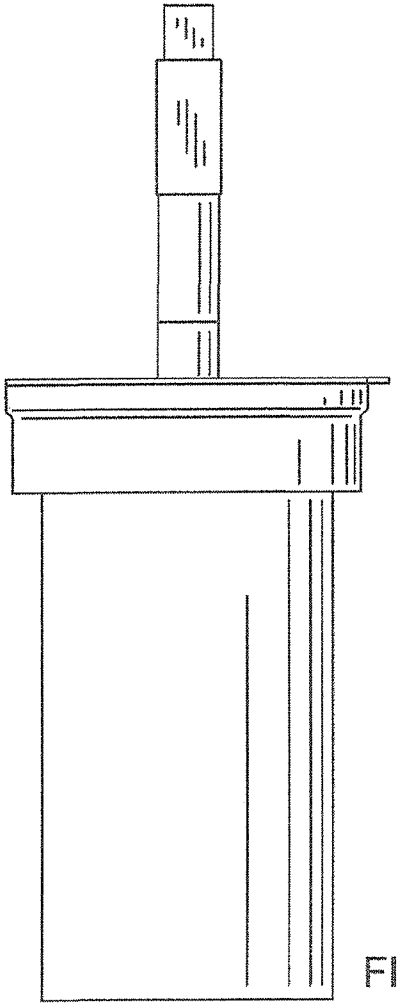
FIG. 36 is a left side elevation view of the cap in FIG. 34.
Figure 39:
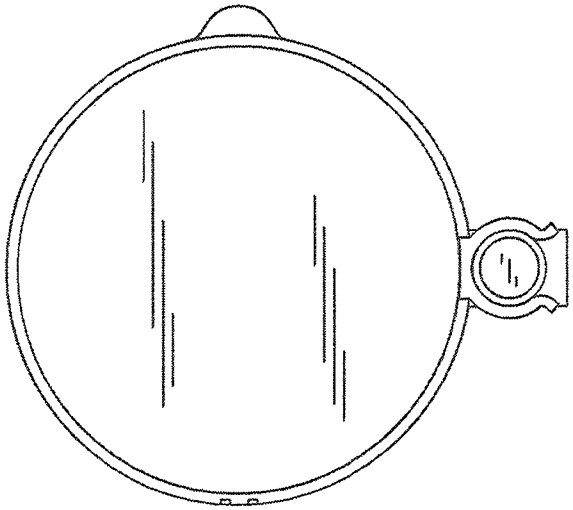
FIG. 39 is a bottom plan view of the cap in FIG. 34.
Figure 38:
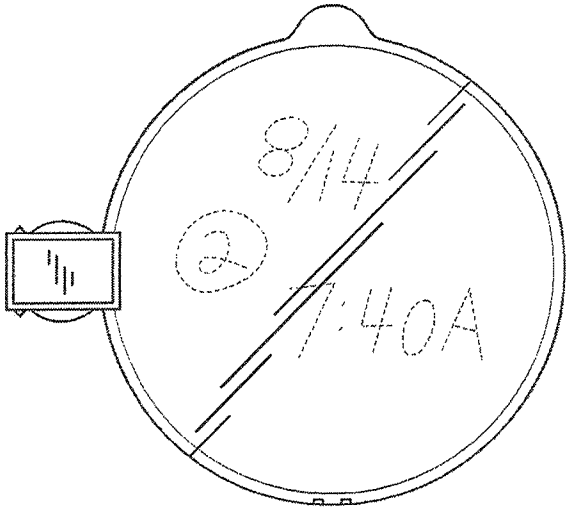
FIG. 38 is a top plan view of the cap in FIG. 34.
Figure 41:
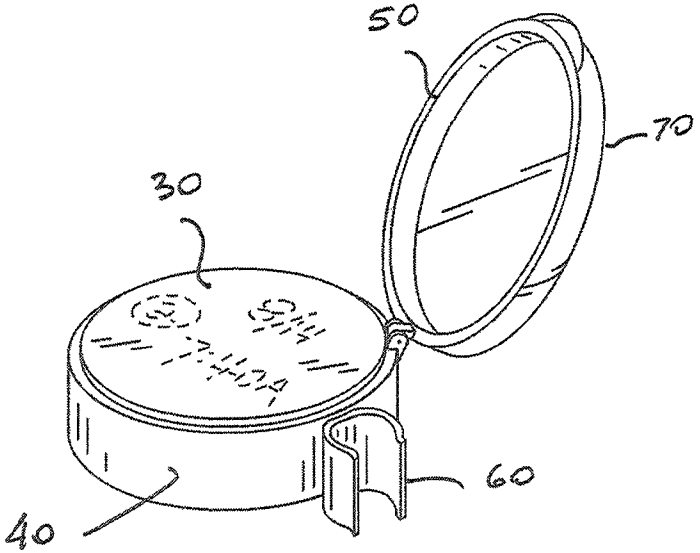
FIG. 41 is another perspective environmental view of the cap of FIG. 40.
Figure 40:
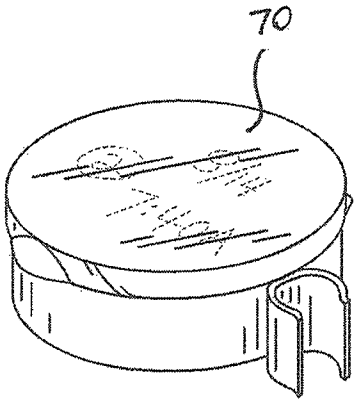
FIG. 40 is one perspective environmental view of a cap of another embodiment with a writing and erasable surface for a medicine container.
Figure 43:
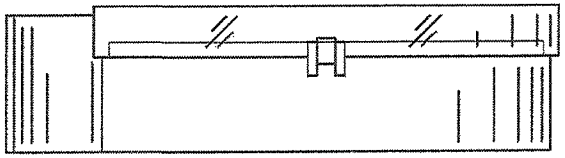
FIG. 43 is a rear elevation view of the cap in FIG. 40.
Figure 44:
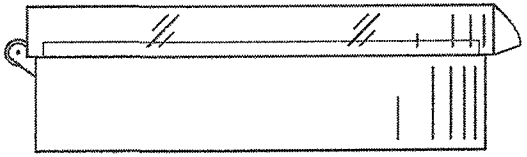
FIG. 44 is a left side elevation view of the cap in FIG. 40.
Figure 46:
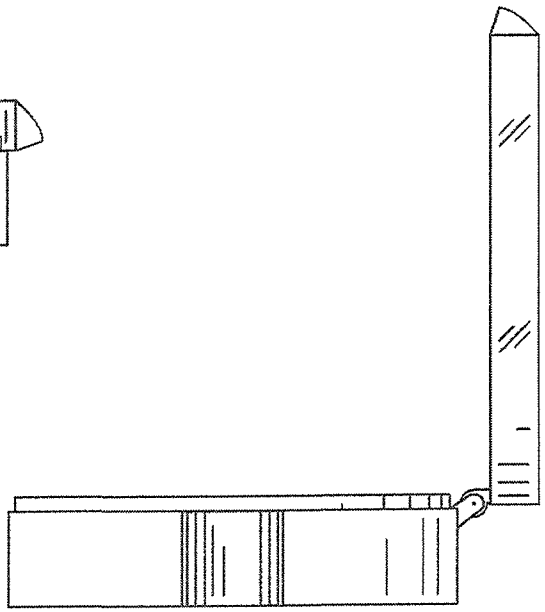
FIG. 46 is a right side elevation view of the cap in FIG. 41.
Figure 42:
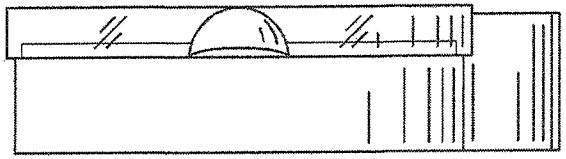
FIG. 42 is a front elevation view of the cap in FIG. 40.
Figure 45:
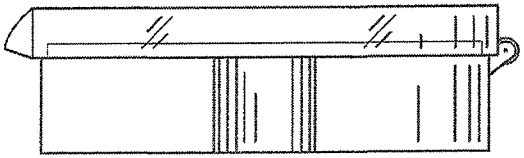
FIG. 45 is a right side elevation view of the cap in FIG. 40.
Figure 48:
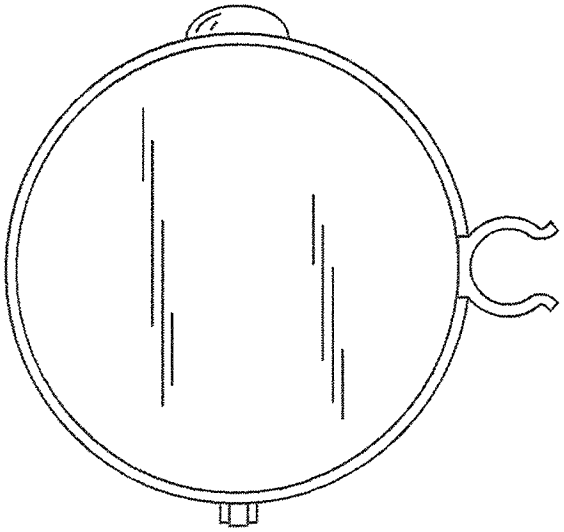
FIG. 48 is a bottom plan view of the cap in FIG. 40.
Figure 47:
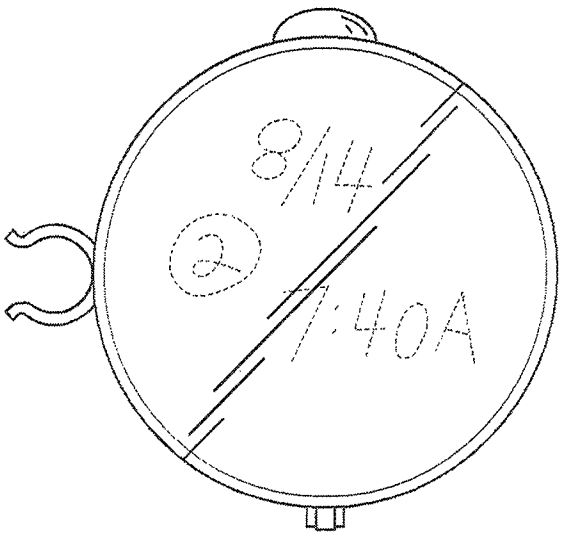
FIG. 47 is a top plan view of the cap in FIG. 40.
Figure 49:
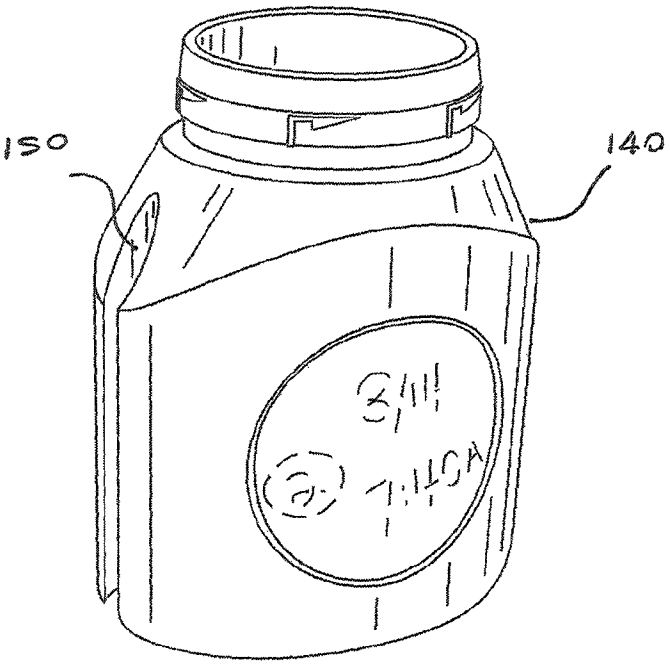
FIG. 49 is a perspective view of a medicine container configured for releaseably retaining writing implement, shown in broken lines.
Figure 50:
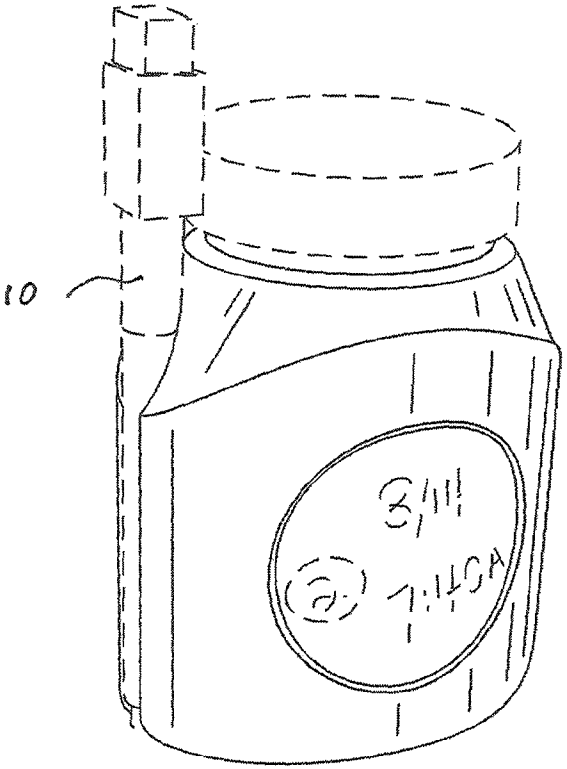
FIG. 50 is a perspective environmental view of the container of FIG. 49 in combination with a cap and writing implement, shown in broken lines.
Figure 52:
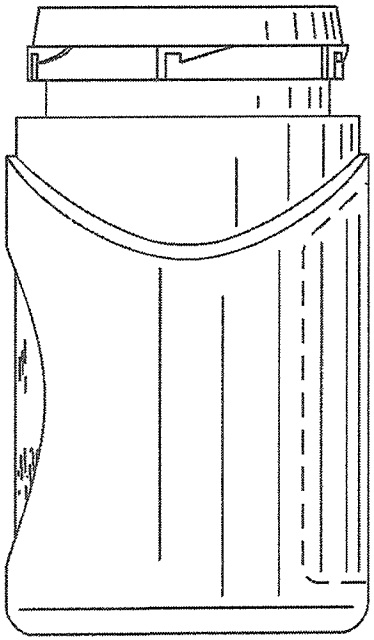
FIG. 52 is a left side elevation view of the container in FIG. 49.
Figure 51:
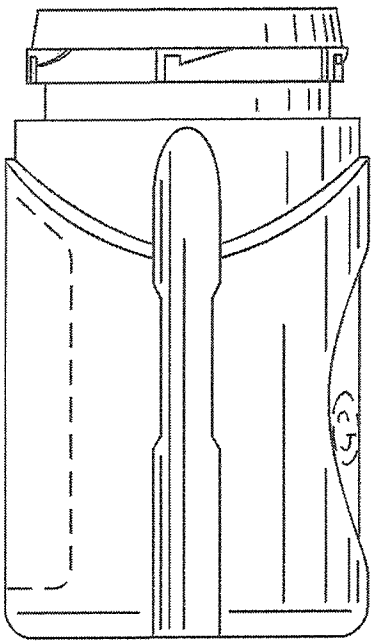
FIG. 51 is a right side elevation view of the container in FIG. 49.
Figure 54:
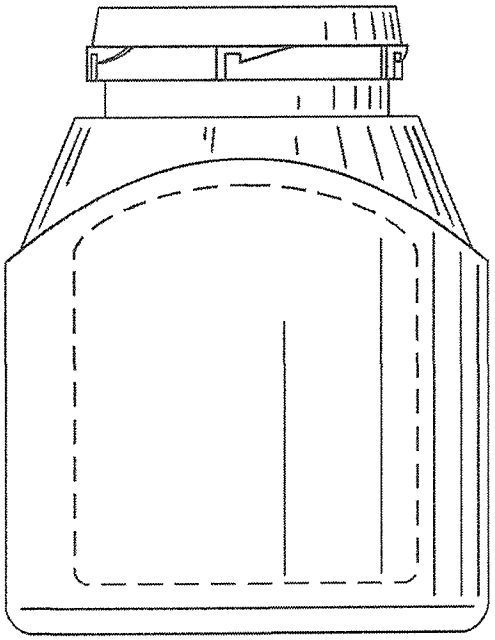
FIG. 54 is a rear elevation view of the container in FIG. 49.
Figure 53:
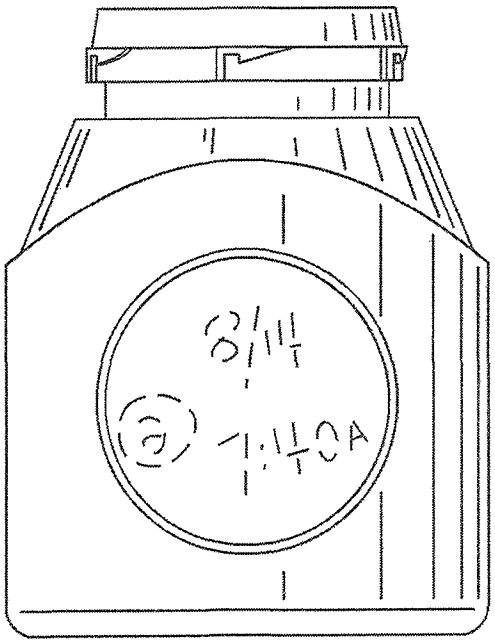
FIG. 53 is a front elevation view of the container in FIG. 49.
Figure 56:
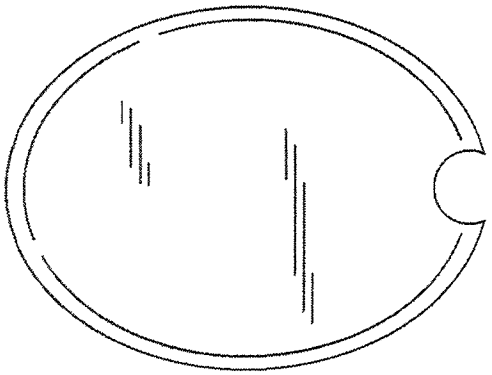
FIG. 56 is a bottom plan view of the container in FIG. 49.
Figure 55:
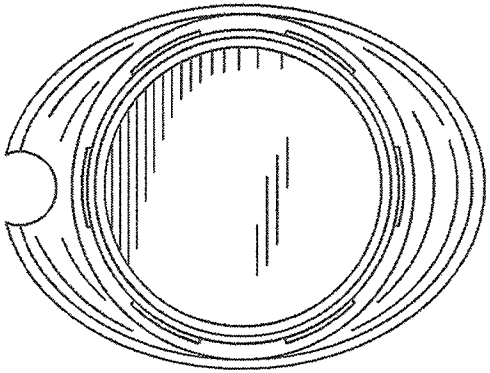
FIG. 55 is a top plan view of the container in FIG. 49.
Figure 59:
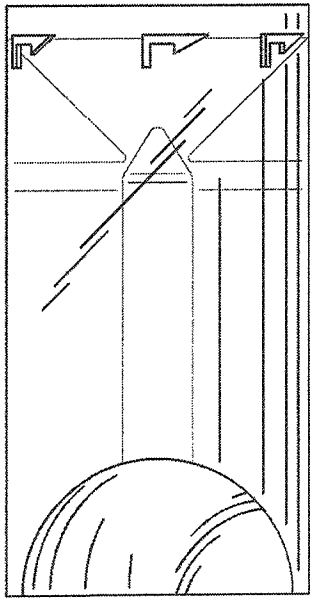
FIG. 59 is a front elevation view of the container in FIG. 57.
Figure 57:
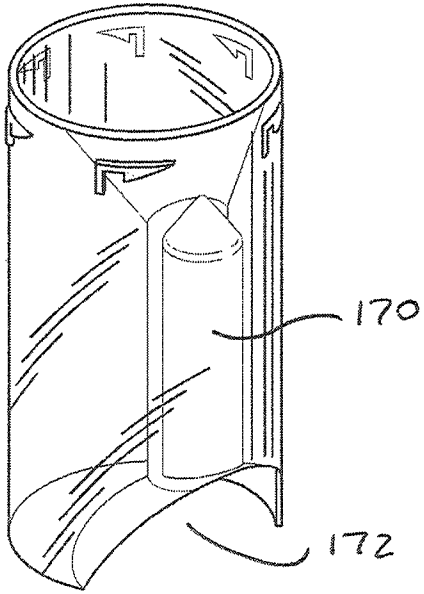
FIG. 57 is a perspective view of a medicine container configured for releaseably retaining writing implement, shown in broken lines.
Figure 58:
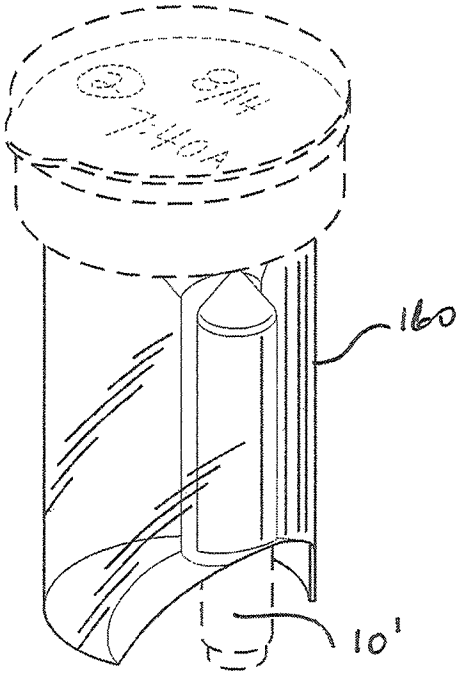
FIG. 58 is a perspective environmental view of a container of in combination with a medicine container and writing implement, shown in broken lines.
Figure 61:
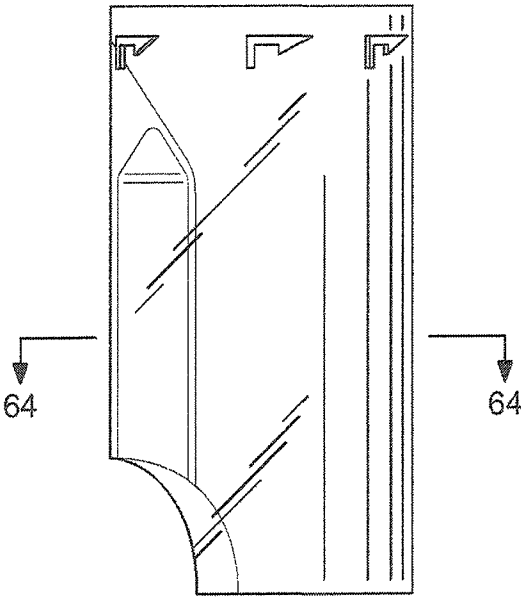
FIG. 61 is a left side elevation view of the container in FIG. 57.
Figure 60:
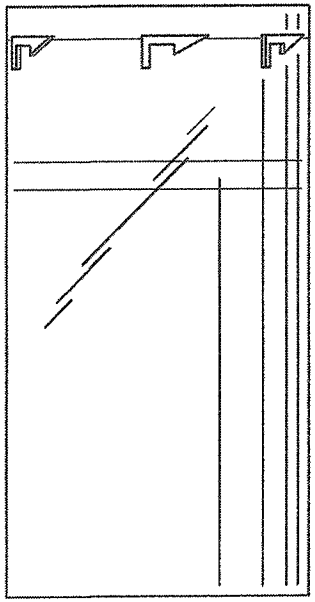
FIG. 60 is a rear elevation view of the container in FIG. 57.
Figure 64:
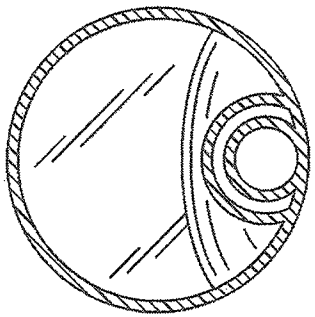
FIG. 64 is a cross-sectional view of the container in FIG. 57.
Figure 63:
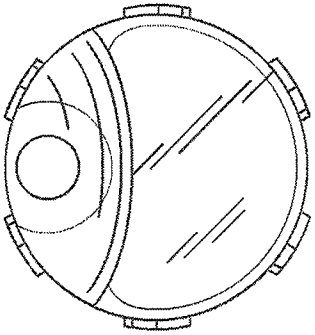
FIG. 63 is a bottom plan view of the container in FIG. 57.
Figure 62:
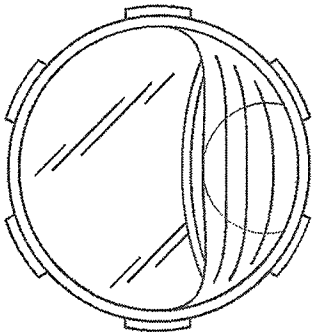
FIG. 62 is a top plan view of the container in FIG. 57.
Figure 66:
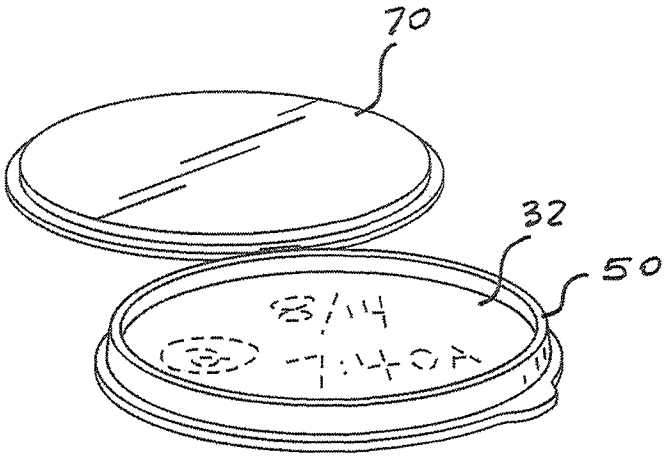
FIG. 66 is another perspective environmental view of the cap of FIG. 65 with the protective lid in an open position.
Figure 65:
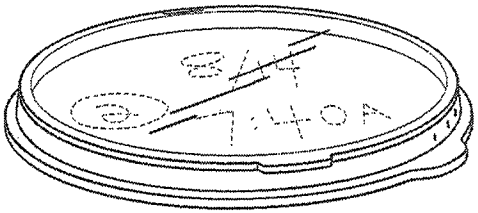
FIG. 65 is one perspective environmental view of a cap of yet another embodiment with a writing and erasable surface for a medicine container.
Figure 68:
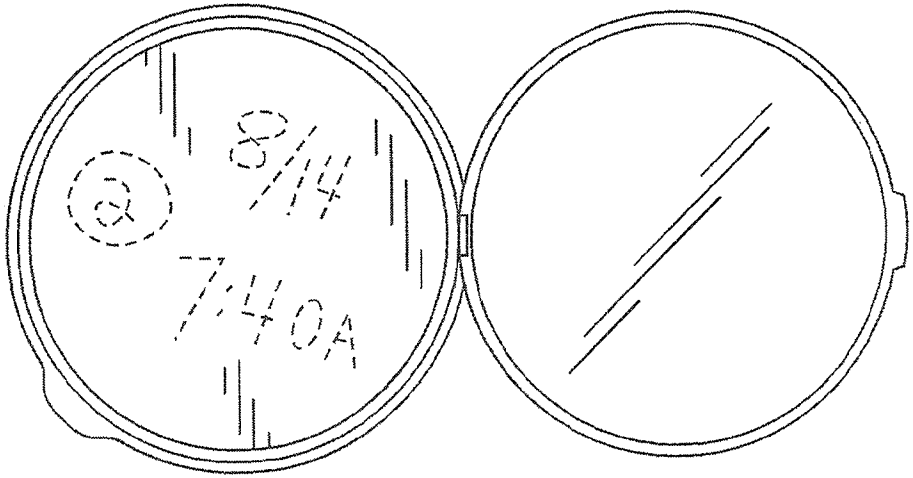
FIG. 68 is a top plan view of the cap in FIG. 66.
Figure 67:
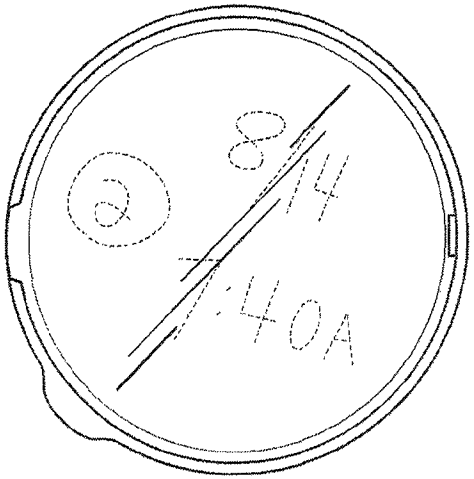
FIG. 67 is a top plan view of the cap in FIG. 65.
Figure 69:
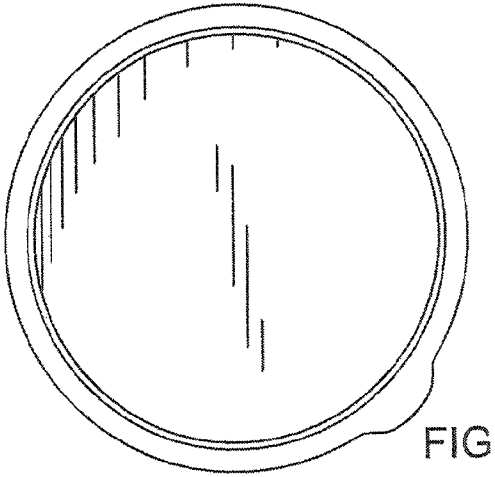
FIG. 69 is a bottom plan view of the cap in FIG. 65.
Figure 71:
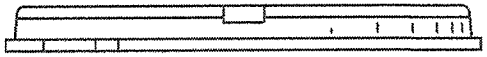
FIG. 71 is a right elevation view of the cap in FIG. 65.
Figure 72:
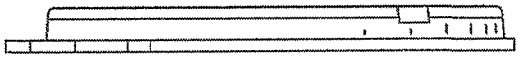
FIG. 72 is a left side elevation view of the cap in FIG. 65.
Figure 74:
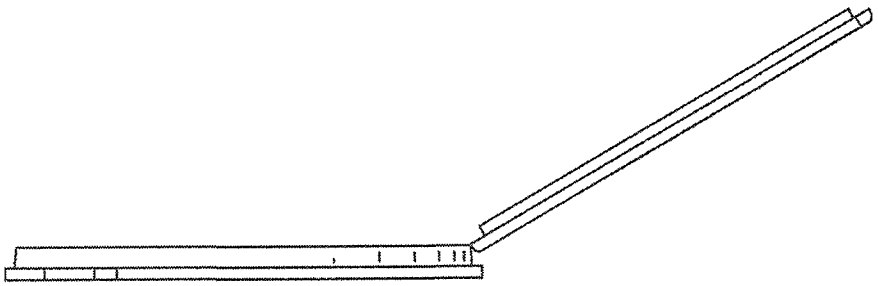
FIG. 74 is a rear elevation view of the cap in FIG. 65.
Figure 70:
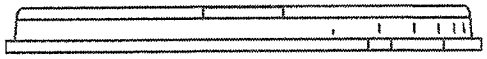
FIG. 70 is a front elevation view of the cap in FIG. 65.
Figure 73:
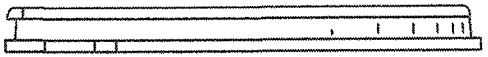
FIG. 73 is a rear elevation view of the cap in FIG. 65.
Figure 76:
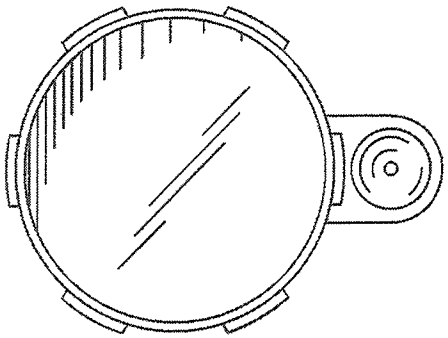
FIG. 76 is a top plan view of the container in FIG. 75.
Figure 77:
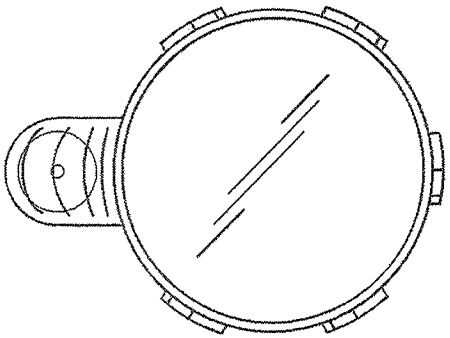
FIG. 77 is a bottom plan view of the container in FIG. 75.
Figure 75:
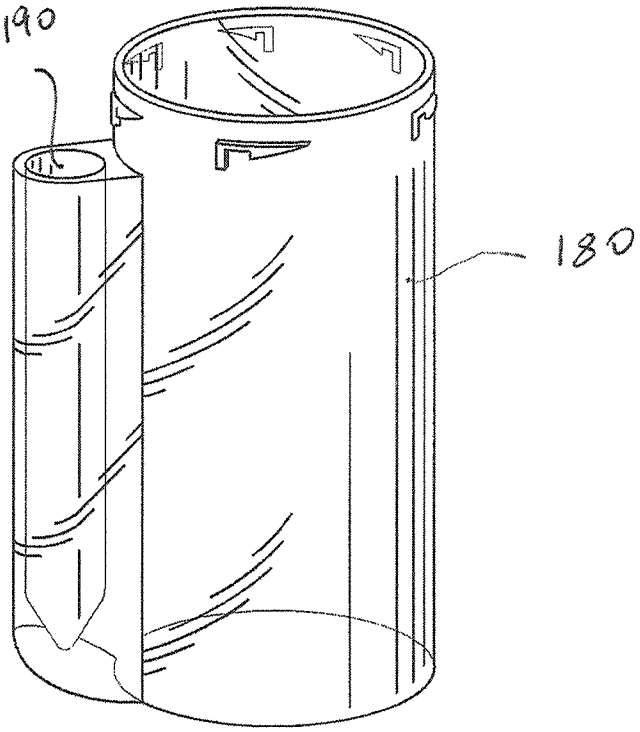
FIG. 75 is a perspective view of a medicine container configured for releaseably retaining writing implement.
Figure 80:
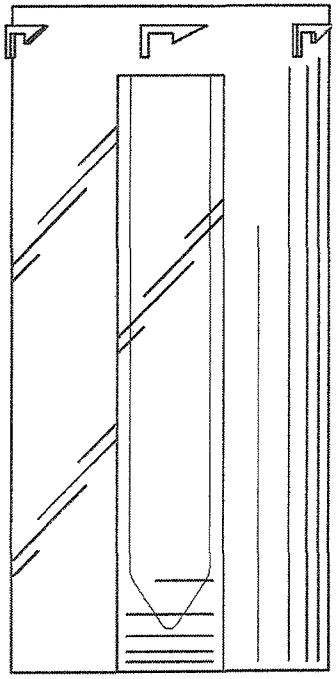
FIG. 80 is a right elevation view of the container in FIG. 75.
Figure 79:
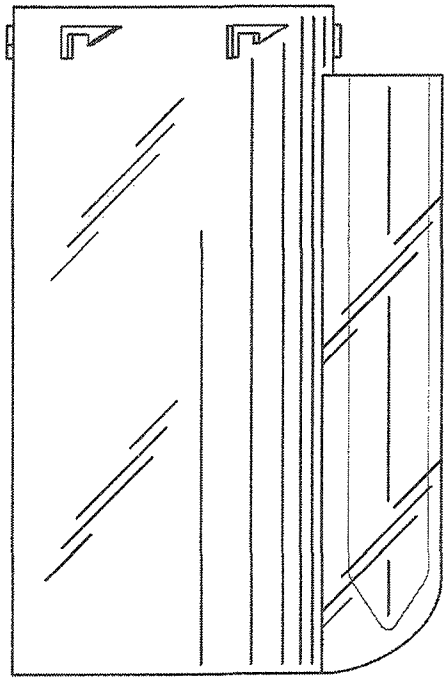
FIG. 79 is a rear elevation view of the container in FIG. 75.
Figure 78:
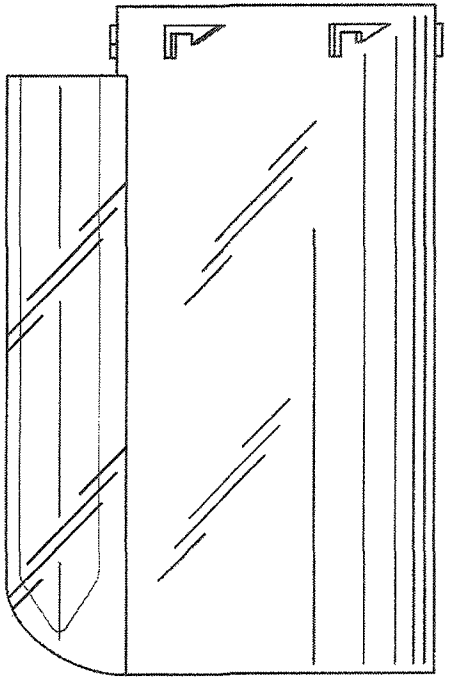
FIG. 78 is a front elevation view of the container in FIG. 75.
Figure 83:
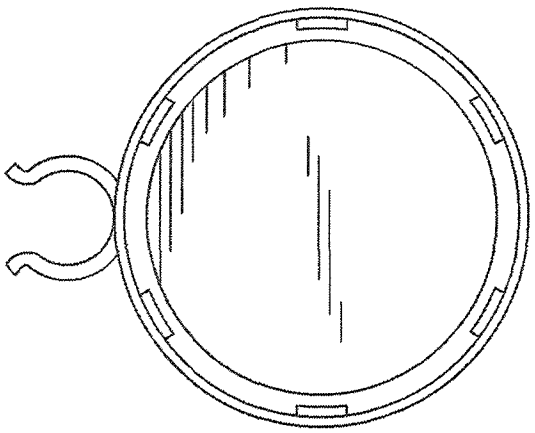
FIG. 83 is a bottom plan view of the cap in FIG. 81.
Figure 84:
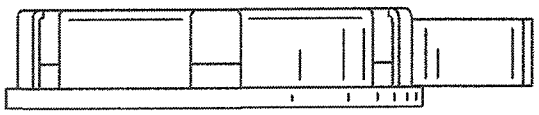
FIG. 84 is a front elevation view of the cap in FIG. 81.
Figure 85:
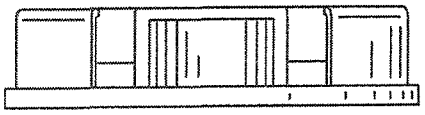
FIG. 85 is a right elevation view of the cap in FIG. 81.
Figure 81:
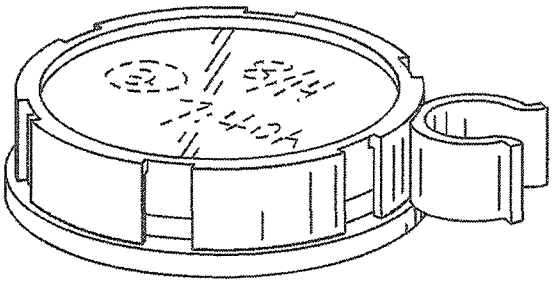
FIG. 81 is one perspective environmental view of a cap of a further embodiment with a writing and erasable surface for a medicine container.
Figure 82:
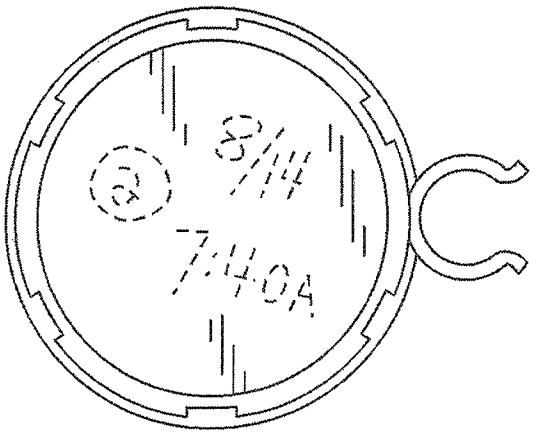
FIG. 82 is a top plan view of the cap in FIG. 81.
Figure 86:
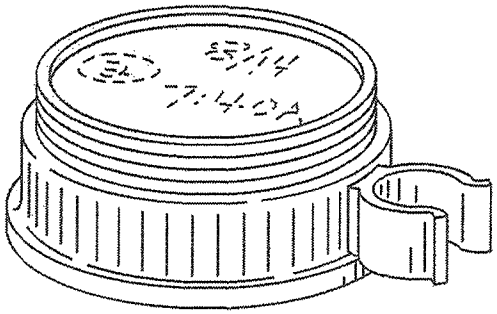
FIG. 86 is one perspective environmental view of a cap of yet a further embodiment with a writing and erasable surface for a medicine container.
Figure 88:
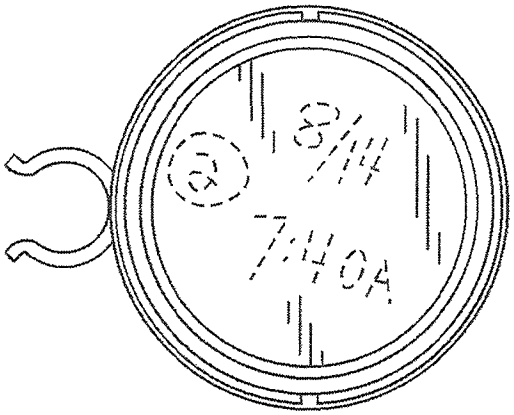
FIG. 88 is a bottom plan view of the cap in FIG. 86.
Figure 87:
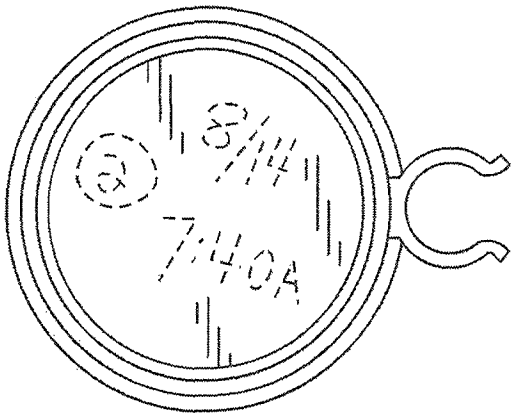
FIG. 87 is a top plan view of the cap in FIG. 86.
Figure 89:
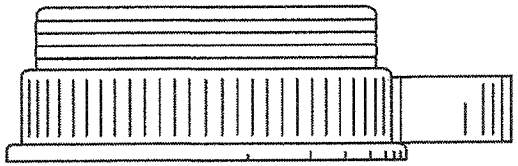
FIG. 89 is a front elevation view of the cap in FIG. 86.
Figure 90:
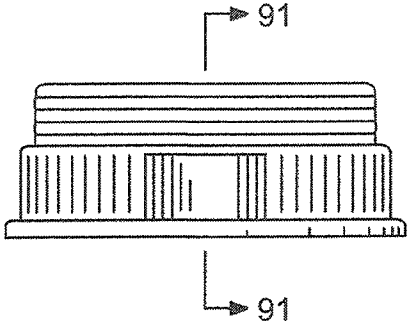
FIG. 90 is a right elevation view of the cap in FIG. 86.
Figure 91:
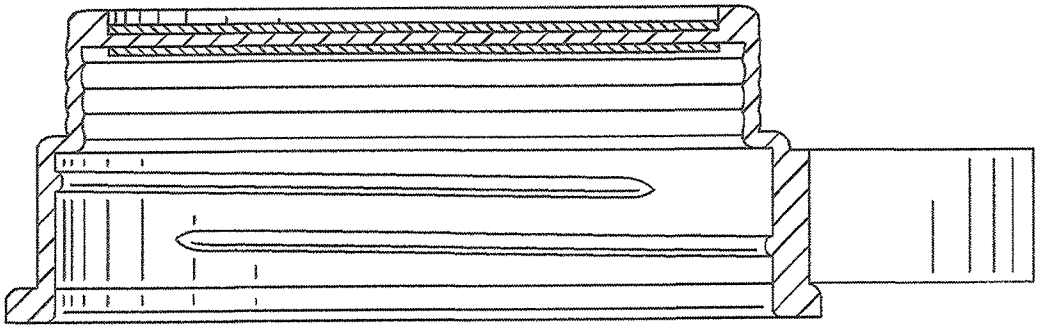
FIG. 91 is a cross-sectional elevation view of the cap in FIG. 86.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Briefly, FIGS. 1-7 illustrate a cap or article of manufacture 20 including a marking member 30 having a marking surface 32, a first peripheral rim 40 adapted for releaseable coupling to an open end of a medicine container 2, a second peripheral rim 50 upstanding above the marking surface 32 and a clip or holder 60 for releaseably retaining or holding writing implement 10.

The marking member 30 may include a rigid member defining a base or a substrate thereof and a generally thin flexible member configured to be attached to the base in one of a permanent and a releaseable manner. Dry Erase Paint is now available. It is called Idea paint. In the future, possibly any marker could write on the surface. In accordance with one embodiment, the article of manufacture further includes an adhesive and wherein the generally thin flexible member is attached to the base with the adhesive in the releaseable or peelable manner, so that the user may replace the marking member 30 either due to wear thereof or due to unintended use of a permanent markers or pens.

The dry erase member may be of the type taught in U.S. Pat. No. 6,620,500, whose teachings are incorporated herein by reference thereto. Briefly, such dry erase member for receiving and releasably retaining a marking composition comprises a substrate coated with a layer of dry erase material on a first face thereof. In specific embodiments, the dry erase coating includes a major amount of a fluorinated polymer or a cellulose acetate based polymer, together with a minor amount of a melamine resin. The dry erase member may include a layer of adhesive on a second face of the substrate to allow for temporary or permanent mounting of the dry erase member onto a surface. In specific embodiments, the dry erase member is flexible.

The dry erase member may be of the type taught in application Ser. No. PCT/US2000/031750, whose teachings are incorporated herein by reference thereto. Briefly, dry erase laminate structure includes a rigid substrate, a thin plastic sheet adhered to the substrate, the plastic sheet having a substantially smooth, hard upper surface, and a nonporous 'UV' hardcoat film bonded to the upper surface of the plastic sheet, thereby providing a glass-like exposed writing surface. The substrate includes a tileboard panel, and optionally a thin steel sheet between the plastic sheet and tileboard to provide a magnetic laminate structure. A white colorant may be provided within the laminate structure to render the exposed surface opaque, and indicia, such as lines, grid, and the like, may be printed within the laminate structure that are visible through the exposed surface.

The holder 60 extends along a height of the peripheral rim and may optionally extend along a height of another peripheral rim 40.

The holder 60, in this and other embodiments, includes an opening 62 facing away from the exterior surface. Furthermore, a cross-sectional shape of the holder 60 in a plane parallel to a plane of the marking member 30 includes a first concave portion abutting an exterior surface of the rim, a pair of second concave portions 66 defining a narrow opening of the holder 60 and a pair of flanges 68 extending outwardly from the pair of second concave portions.

Alternatively, the holder 60 may include an annular cross-sectional shape in a plane parallel to a plane of the marking surface. In this embodiment, the holder 60 includes a flexible and resilient material defining a tubular shape thereof.

In this and other embodiments, the article of manufacture may further include one of threads and projections disposed on the interior surface of the first peripheral rim 40. In this and other embodiments, the first and/or the second peripheral rims, 40 and 50 respectively, are manufactured from a transparent or opaque material.

FIGS. 8-13 illustrate a system including a container 100 having a closed end, an axially opposite open end and a peripheral surface; a cap 20 including a marking surface, a first peripheral rim 40 adapted for releaseable coupling to an open end of the container 100, a second peripheral rim 50 upstanding above the marking member 30 and a clip or holder 60 for releaseably retaining or holding writing implement 10; and the writing implement 10.

FIGS. 14-24 illustrate a cap 20 including a marking surface, a first peripheral rim 40 adapted for releaseable coupling to an open end of a medicine container 2, a second peripheral rim 50 upstanding above the marking surface, a clip or holder 60 for releaseably retaining or holding writing implement 10, and a transparent lid 70 movable between a first position being generally coplanar with the marking member 30 so as to prevent access thereto and a second position being disposed at an acute, right or obtuse angle to the marking member 30 so as to allow access thereto.

FIGS. 25-33 illustrate a cap 20 including a marking surface, a first peripheral rim 40 adapted for releaseable coupling to an open end of a medicine container 2, a second peripheral rim 50 upstanding above the marking surface, a clip or holder 60 for releaseably retaining or holding writing implement 10, and a non-transparent lid 70 movable between a first position being generally coplanar with the marking member 30 so as to prevent access thereto and a second position being disposed at an acute, right or obtuse angle to the marking member 30 so as to allow access thereto.

FIGS. 34-39 illustrate a system including a container 120 having a closed end, an axially opposite open end and a peripheral surface; a cap 20 including a marking surface, a first peripheral rim 40 adapted for releaseable coupling to an open end of the container 120, a second peripheral rim 50 upstanding above the marking surface, a clip or holder 60 for releaseably retaining or holding writing implement 10, a transparent lid 70 movable between a first position being generally coplanar with the marking member 30 so as to prevent access thereto and a second position being disposed at an acute, right or obtuse angle to the marking member 30 so as to allow access thereto; and the writing implement 10.

FIGS. 40-48 illustrate a cap 20 including a marking member 30, a first peripheral rim 40 adapted for releaseable coupling to an open end of a medicine container 2, a clip or holder 60 for releaseably retaining or holding writing implement 10, and a transparent lid 70 having a second peripheral rim 50, the transparent lid 70 movable between a first position being generally coplanar with the marking member 30 so as to prevent access thereto and a second position being disposed at an acute, right or obtuse angle to the marking member 30 so as to allow access thereto.

FIGS. 49-56 illustrate a medicine container 140 that includes a channel 150 running along the height thereof, the channel 150 is configured to releaseably retain a writing implement 10.

FIGS. 57-64 illustrate a container 160 comprising a closed end, axially open end, and a peripheral wall defining a height of the container 2 and a hollow interior thereof, the container 160 further comprising an elongated pocket 170 disposed along and aligned with a portion of the peripheral wall or inclined at an angle thereto. The pocket 170 is disposed within the hollow interior and has an opening 172 disposed at the closed end of the container 160.

FIGS. 65-74 illustrate a cap 20 having a body with an interior surface configured for a snap-on friction fit with an open top of the medicine container 2, a writing surface disposed on a surface of the body, a peripheral rim upstanding on the writing surface, a transparent lid 70 having a second peripheral rim 50, the transparent lid 70 movable between a first position being generally coplanar with the marking member 30 so as to prevent access thereto and a second position being disposed at an acute, right or obtuse angle to the marking member 30 so as to allow access thereto. The transparent lid 70 has an abutment sized to fit, either by a friction fit or by a snap fit, into an interior of the peripheral rim.

FIGS. 75-80 illustrate a container 180 comprising a closed end, axially open end, and a peripheral wall defining a height of the container 180 and a hollow interior thereof, the container 180 further comprising an elongated pocket 190 disposed along and aligned with a portion of the peripheral wall or inclined at an angle thereto. The pocket is inclined at an angle to the peripheral wall and has an opening formed therethrough proximal the open end of the container 180.

FIGS. 81-85 illustrate a cap 20 with a writing surface. The cap 20 is essentially the same as the cap 20 currently used at CVS pharmacies.

FIGS. 86-91 illustrate a cap 20 that is constructed essentially the same as the cap 20 currently used at Walgreens pharmacies and being of a dual use in locking (child-resistant) or non-locking modes. Such cap 20 is adapted with a pair of writing members or a pair of writing surfaces so that the user can record needed information irregardless of whether the cap 20 is used in a locking or non-locking modes.

In either of the above embodiments, the article of manufacture of may further comprise a writing implement 10, wherein the holder 60 is sized to releaseably receive the writing implement 10. The writing implement 10 is preferably a dry-erase marker preferably having a cap 20 and an erasing portion, although markers inserted into the pocket may be provided without the cap 20, which is essentially define by the closed end of the pocket. The dry-erase marker may be of any conventional type.

The cap 20 and the bottle are manufactured from any conventional materials.

Figure 92:
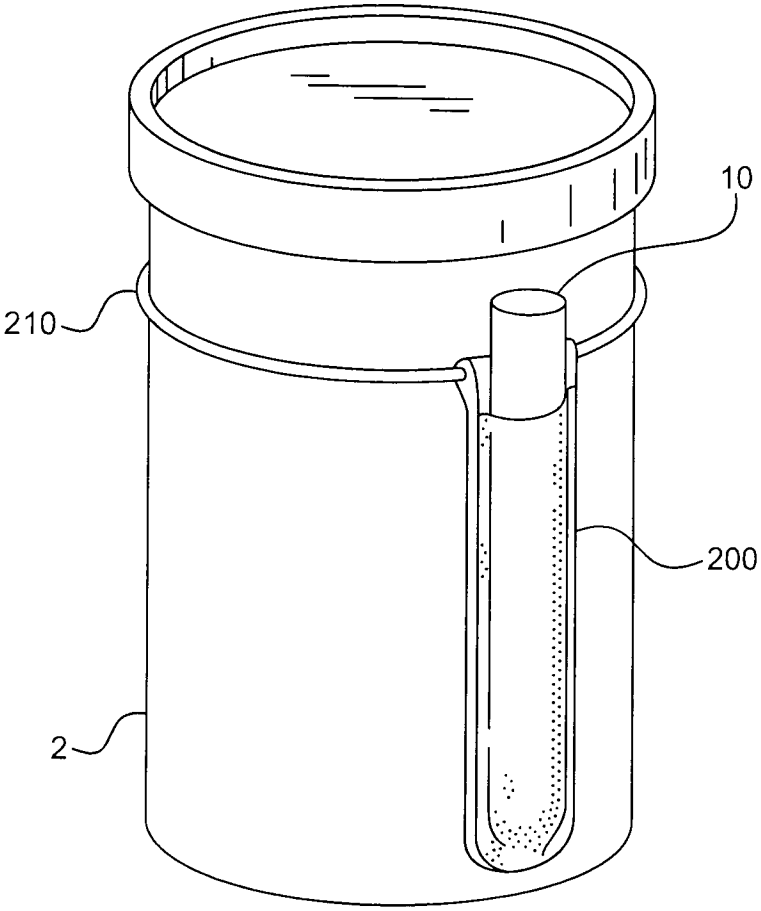
FIG. 92 illustrates a device configured to receive a writing implement therewithin and is further configured to attach onto a surface of a container.
Figure 94:
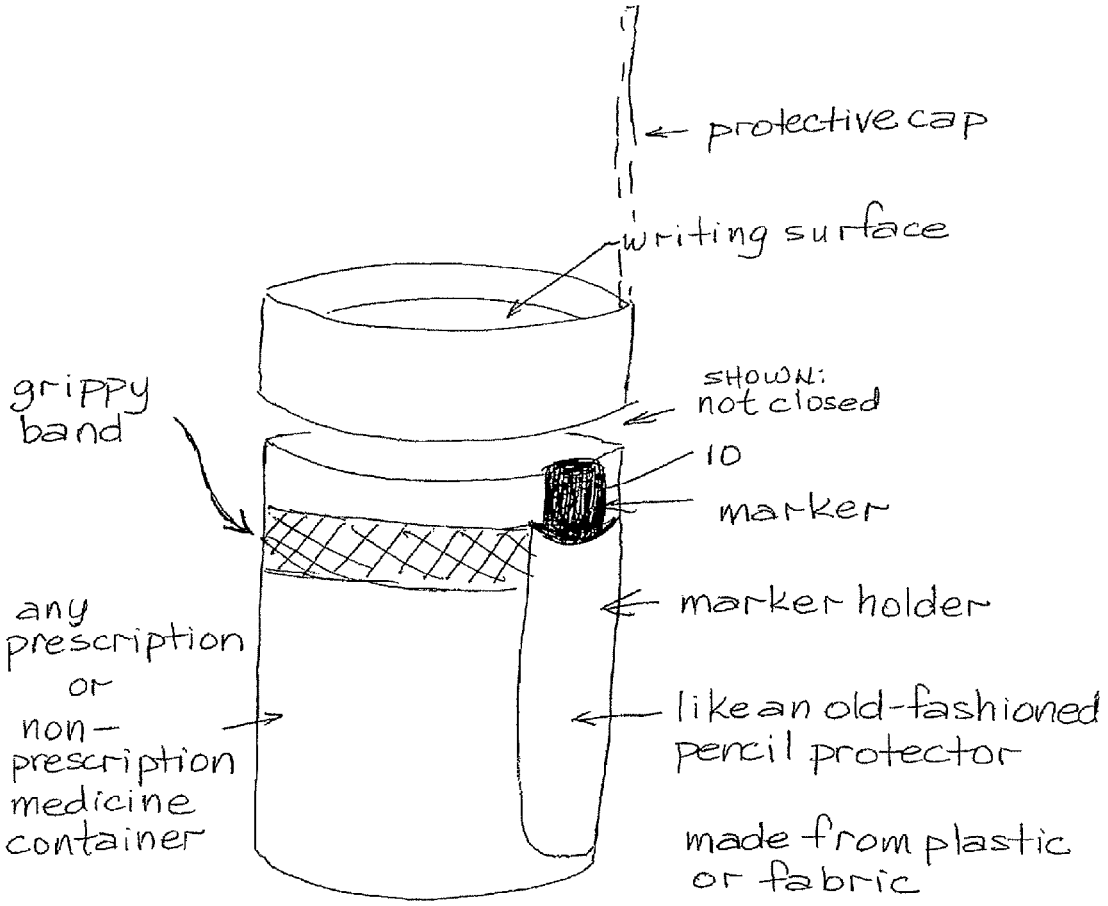
FIG. 94 illustrates a device configured to receive a writing implement therewithin and is further configured to attach onto a surface of a container.

Now in reference to FIGS. 92 and 94, therein is illustrated a device 200 including a pocket, that may be manufactured from a flexible or rigid material and that is configured to receive a writing implement 10 therewithin. The device is further configured to attach onto a surface of a container 2 for example, with an elastic and resilient strap or band 210.

Figure 93:
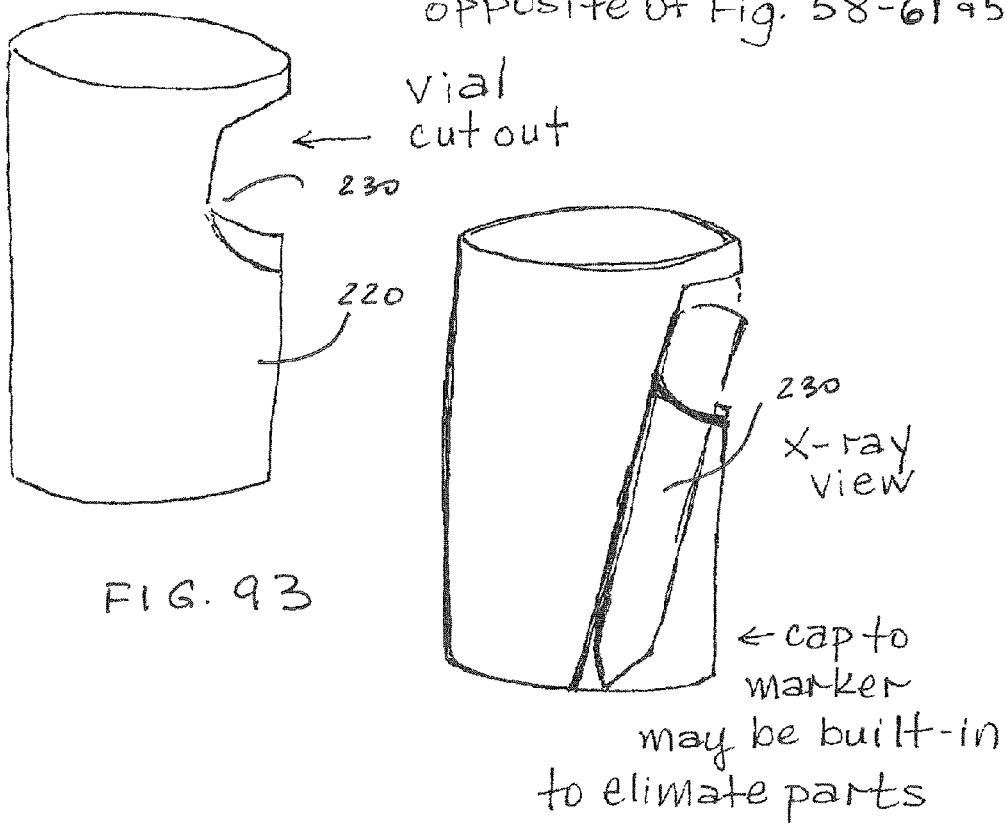
FIG. 93 illustrates another container with the pocket for the writing implement being inclined at an angle relative to the peripheral wall.

FIG. 93 illustrates another container 220 with the pocket 230 for the writing implement being inclined at an angle relative to the peripheral wall with the pocket opening being disposed proximal the top open end of the container.

The method simply involves reviewing previous dosage information on the writing surface. The user then determines if an additional dose can or should be administered, according to medication instructions.

If a dose will be given, the user first erases the indicia from the writing surface with a hand, cloth, or marker eraser. The writing implement is then removed from the above described clip or pockets.

Immediately after administering the medication, the user writes the current time, including "A" for a.m. and "P" for p.m. on the writing surface. This time is known as the Last Dose Given. Last Dose Given is terminology used in hospitals and medical facilities. The ultimate goal is that the right patient received the right drug in the right amount via the right route at the right time.

The user should use the writing implement to then record the amount of medication given and circle it. For example, the number "2" should be circled for the amount of 2 pills, cc's, ml's, or teaspoonfuls. The date should be included, particularly in the case of "once daily" medications. The writing implement is then reattached to the cap or the medicine container. The process of erasing and adding additional marks/indicia would then be repeated every time a subsequent dose of medication is administered.

The method simply includes the steps of writing on the writing surface the date and time of the last dose of medication as well as the quantity of medication that was consumed. The indicia are then removed with the eraser and the new day/time an dose, were necessary, are written.

At a predetermined periodic interval, the user would require an additional dosage of the medicine and may detach the identification portion from the medicine container. The user would administer an additional dosage of medicine based on the medicine instructions displayed on the marking surface. The previous medicine instructions would be erased by rubbing. A cloth or hand may be utilized for erasing the medicine instructions. The user would mark new medicine instructions on to the marking surface to reflect the most recent administration of the medicine. Immediately after administering the medicine, the user would mark the time (present) that the dose was given to reflect the most recent administration of the medicine. The process of erasing and adding additional marks onto the marking surface would then be repeated every time a subsequent dosage of medicine was administered. The writing implement is repeatedly removed and reattached to the cap and/or container.

Although, the invention has been described for use with medications, such invention can be used in other applications where contents must be described or their consumption must be recorded.

I claim:

1. An article of manufacture comprising:

a planar reusable marking member configured for receiving writing thereon and erasing writing therefrom;

a peripheral rim extending from said marking member and having an interior surface thereof configured for attachment onto an open end of a container; and a holder disposed on at least an exterior surface of said peripheral rim, said holder configured to releaseably secure a longitudinal writing implement extending perpendicular to said plane of said marking member.

2. The article of manufacture of claim 1, wherein said holder includes an opening facing away from said exterior surface.

3. The article of manufacture of claim 2, wherein a cross-sectional shape of said holder in a plane parallel to said plane of said marking member includes a first concave portion abutting an exterior surface of said rim, a pair of second concave portions defining a narrow opening of said holder and a pair of flanges extending outwardly from said pair of second concave portions.

4. The article of manufacture of claim 2, wherein said holder includes an annular cross-sectional shape in a plane parallel to said plane of said marking member.

5. The article of manufacture of claim 2, wherein said holder includes a flexible and resilient material defining a tubular shape thereof.

6. The article of manufacture of claim 1, further comprising a transparent lid hingeably attached to at least one of said peripheral rim and said marking member, said transparent lid movable between a first position being generally coplanar with said marking member so as to prevent access thereto and a second position being disposed at one of an acute, right and obtuse angle to said marking member so as to allow access thereto, wherein an inner surface of said transparent lid is spaced a distance from said marking surface.

7. The article of manufacture of claim 1, further comprising a transparent lid having another peripheral rim thereof hingeably attached to at least one of said peripheral rim and said marking surface, said transparent lid movable between a first position being generally coplanar with said marking member so as to prevent access thereto and a second position being disposed at one of an acute, right and obtuse angle to said marking member so as to allow access thereto.

8. The article of manufacture of claim 1, further including one of threads and projections disposed on said interior surface of said peripheral rim.

9. The article of manufacture of claim 1, wherein said rim is manufactured from a transparent or opaque material.

10. The article of manufacture of claim 1, further comprising another peripheral rim upstanding on said marking member.

11. The article of manufacture of claim 10, further comprising a transparent lid hingeably attached to said another peripheral rim, said transparent lid movable between a first position being generally coplanar with said marking member so as to prevent access thereto and a second position being disposed at one of an acute, right and obtuse angle to said marking member so as to allow access thereto.

12. The article of manufacture of claim 10, wherein said holder further extends along a height of said another peripheral rim.

13. The article of manufacture of claim 1, further comprising a transparent lid and another peripheral rim rigidly attached to or being integral with said lid and hingeably attached to said peripheral rim, said transparent lid movable between a first position being generally coplanar with and spaced apart from said marking member so as to prevent access thereto and a second position being disposed at one of an acute, right and obtuse angle to said marking member so as to allow access thereto.

14. The article of manufacture of claim 1, wherein said marking member includes a rigid member defining a base thereof and a generally thin flexible member configured to be attached to said base in one of a permanent and a releaseable manner.

15. The article of manufacture of claim 14, further comprising an adhesive and wherein said generally thin flexible member is attached to said base with said adhesive in said releaseable manner.

16. The article of manufacture of claim 14, further comprising a writing implement and wherein said holder is sized to releaseably receive said writing implement.

17. The article of manufacture of claim 1, further comprising the container, wherein said peripheral rim and said marking member are configured to close the open end of the container and wherein the marking implement is further releaseably securable in a direction along a length or height of the container.

18. An article of manufacture comprising:

a planar reusable marking member configured for receiving writing thereon and erasing writing therefrom;

a peripheral rim extending from said plane of said marking member and having an interior surface thereof configured for attachment onto an exterior surface of an open end of a container, wherein said marking member covers the open end of the container when said peripheral rim is attached thereto; and a holder disposed on at least an exterior surface of said peripheral rim, said holder configured to releaseably secure a writing implement.

* * * * *